US009027920B2

(12) United States Patent
Sato et al.

(10) Patent No.: US 9,027,920 B2
(45) Date of Patent: May 12, 2015

(54) SHEET STACKING APPARATUS, SHEET FEEDING APPARATUS, AND IMAGE FORMING APPARATUS

(71) Applicant: Canon Kabushiki Kaisha, Tokyo (JP)

(72) Inventors: Masaki Sato, Kawasaki (JP); Yuichi Obara, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/324,517

(22) Filed: Jul. 7, 2014

(65) Prior Publication Data

US 2015/0021852 A1 Jan. 22, 2015

(30) Foreign Application Priority Data

Jul. 16, 2013 (JP) ..... 2013-147390
Sep. 24, 2013 (JP) ..... 2013-196584

(51) Int. Cl.

| | |
|---|---|
| ***B65H 1/00*** | (2006.01) |
| ***B65H 1/04*** | (2006.01) |
| ***B65H 1/08*** | (2006.01) |
| ***B65H 5/00*** | (2006.01) |

(52) U.S. Cl.
CPC .. *B65H 1/04* (2013.01); *B65H 1/08* (2013.01); *B65H 5/00* (2013.01)

(58) Field of Classification Search
USPC ..... 271/171; 399/393
See application file for complete search history.

(56) References Cited

U.S. PATENT DOCUMENTS

| | | | |
|---|---|---|---|
| 8,246,045 | B2 | 8/2012 | Kubo |
| 8,870,182 | B2 | 10/2014 | Ogata et al. |
| 2009/0295068 | A1 | 12/2009 | Kubo |

FOREIGN PATENT DOCUMENTS

| | | | |
|---|---|---|---|
| JP | 2007-197159 | A | 8/2007 |
| JP | 2008-105856 | A | 5/2008 |
| JP | 2009-286572 | A | 12/2009 |
| JP | 4590356 | B2 | 12/2010 |
| JP | 5058740 | B2 | 10/2012 |
| JP | 5207831 | B2 | 6/2013 |

*Primary Examiner* — Michael McCullough
(74) *Attorney, Agent, or Firm* — Fitzpatrick, Cella, Harper & Scinto

(57) ABSTRACT

A sheet stacking apparatus has a rotating portion provided in an operation member to rotate around a first rotation fulcrum, an elastic portion provided in the operation member to be elastically deformed by the rotating portion being rotated, and a disengaging portion that rotates an engaging portion between an engagement position and a disengagement position by the elastic portion being elastically deformed.

17 Claims, 22 Drawing Sheets

SHEET STACKING APPARATUS, SHEET FEEDING APPARATUS, AND IMAGE FORMING APPARATUS

BACKGROUND OF THE INVENTION

1. Field of the Invention

The present invention relates to a sheet stacking apparatus, a sheet feeding apparatus, and an image forming apparatus.

2. Description of the Related Art

A universal cassette supporting sheets of various sizes by the same sheet cassette is conventionally used as a sheet cassette provided in a copying machine, a printer, a facsimile machine and the like. The universal cassette is provided with a regulating member to position a sheet end (see, for example, Japanese Patent Laid-Open No. 2007-197159, US 2009/0295068 A1, or Japanese Patent Laid-Open No. 2008-105856).

Then, the position of a sheet is regulated by moving the regulating member to normal positions of various sizes. However, a state in which the regulating member cannot hold a sheet in its normal position may arise after the regulating member moves from the normal position due to an impact caused by insertion/removal of a cassette or the like so that a malfunction such as poor feeding, skew feeding, or double feeding of a sheet occurs during feeding operation.

According to Japanese Patent Laid-Open No. 2007-197159, when a force is applied to a regulating member, movement of the regulating member is regulated by a first engaging portion or a second engaging portion according to the direction in which the force is applied. However, first and second tooth rows are each arranged stepwise and therefore, the height of a holding portion increases and a sheet cassette increases in size, leading to higher costs.

According to US 2009/0295068 A1, a regulating member is reliably held in the regulating position according to the direction in which a force is applied to the regulating member by providing first and second engaged portions in parallel with the bottom of a cassette body and also providing a first engaging member or a second engaging member in parallel with the regulating member. However, the first engaging member or the second engaging member is provided separately and also an elastic member pressing a lock lever is used and therefore, the number of components increases and assembling properties are poor, leading to higher costs.

According to Japanese Patent Laid-Open No. 2008-105856, a regulating member is brought to a fixed state by one engaging portion of the regulating member and thus, when a force is applied to the regulating member, the regulating member can be held in the regulating position only in one direction. However, in addition to the cassette body and the regulating member, many components such as a holding member and an elastic member are used and therefore, assembling properties are poor, leading to higher costs. In addition, the number of components is large and thus, rattling while the regulating member is fixed increases and position regulation of sheet varies, which could lead to deterioration of print precision.

It is desirable to reduce the size of a sheet cassette by reducing the height of a holding portion and to improve assembling properties by reducing the number of components around a regulating member.

SUMMARY OF THE INVENTION

A representative configuration of the present invention to achieve the above desirability is a sheet stacking apparatus including a stacking unit on which a sheet is stacked and a regulating unit provided movably in a first direction and a second direction, which is an opposite direction of the first direction, to regulate a position of the sheet by abutting on an end of the sheet stacked on the stacking unit, wherein the stacking unit includes a stacking member on which the sheet is stacked and an engaged portion provided along a direction of movement of the regulating unit and the regulating member includes an abutting portion that abuts on the end of the sheet stacked on the stacking member, an engaging member including an engaging portion provided movably between an engagement position where engaged with the engaged portion and a disengagement position where not engaged with the engaged portion in a direction perpendicular to the direction of movement of the regulating unit and a horizontal direction, an operation member, a rotating portion provided in the operation member to rotate around a first rotation fulcrum, an elastic portion provided in the operation member to be elastically deformed by the rotating portion being rotated, and a disengaging portion provided in the operation member to rotate the engaging portion between the engagement position and the disengagement position by the elastic portion being elastically deformed.

Further features of the present invention will become apparent from the following description of exemplary embodiments with reference to the attached drawings.

DESCRIPTION OF THE EMBODIMENTS

First Embodiment

The first embodiment of the present invention will be described using the drawings. The description will be provided in the order of the overall configuration of an image forming apparatus, the configuration of a cassette body, the overall configuration of a rear end regulating member, a holding mechanism portion, and a disengaging mechanism. Here, a laser beam printer is exemplified as the image forming apparatus.

<Overall Configuration of an Image Forming Apparatus>

Figure 1:
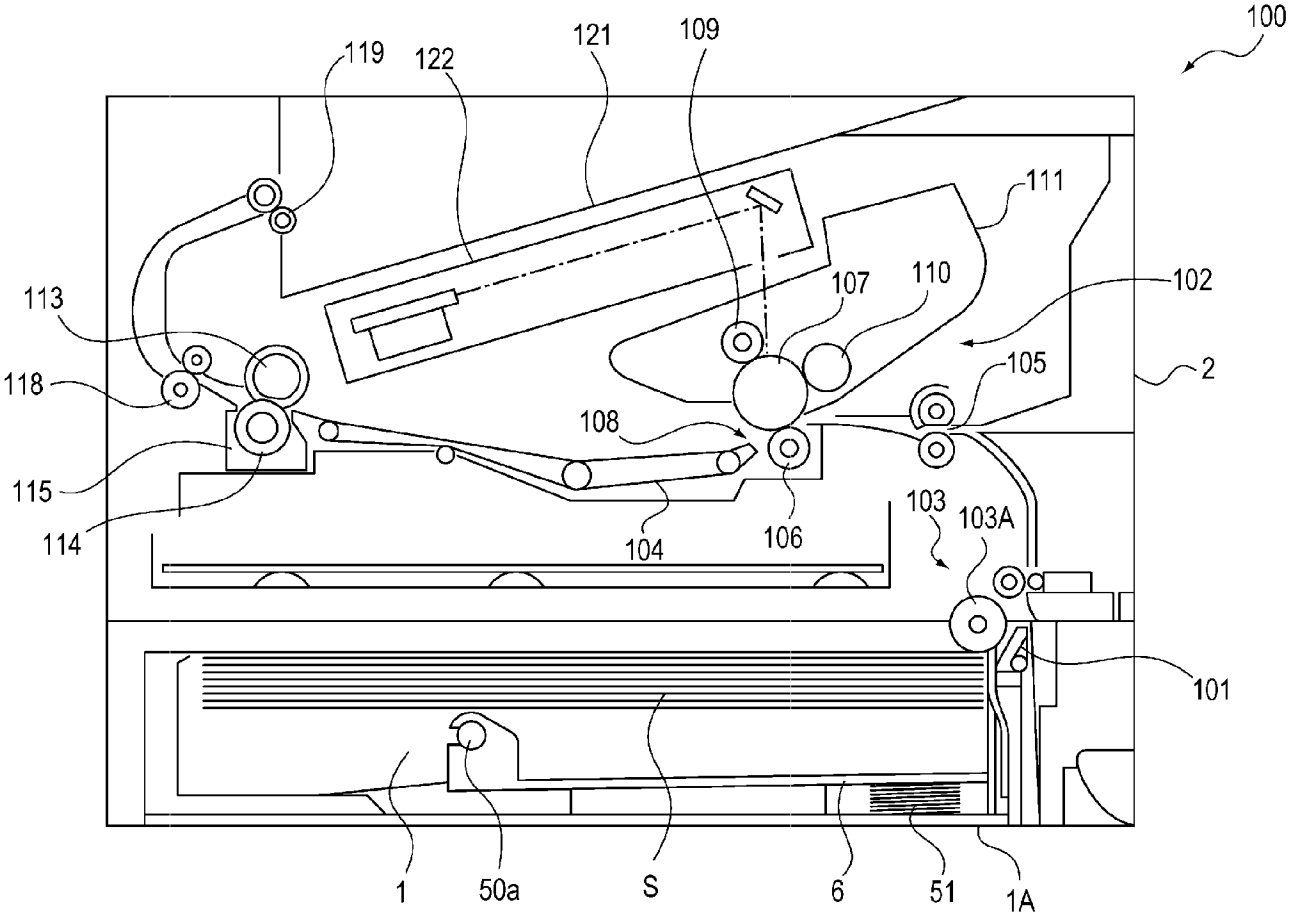
FIG. 1 is a sectional view of an image forming apparatus including a sheet feeding apparatus according to a first embodiment.

An overview of the overall configuration of an image forming apparatus will be described using FIG. 1. FIG. 1 is a sectional view of an image forming apparatus including a sheet feeding apparatus according to the first embodiment. FIG. 1 exemplifies a laser beam printer as an example of an image forming apparatus 100 including a sheet cassette 1 (sheet feeding portion). The sheet cassette 1 is a universal cassette supporting sheets of various sizes and is configured to be detachably attached to an apparatus body 2 of the image forming apparatus 100.

In FIG. 1, the image forming apparatus 100 has an image forming portion 102 that forms an image by an electrophotographic system and a sheet feeding apparatus 103 that feeds a sheet S to the image forming portion 102 inside the apparatus body 2.

The image forming portion 102 has a photosensitive drum 107 that forms a toner image, a transfer roller 106 that transfers a toner image formed on the photosensitive drum 107 to the sheet S, a charging roller 109 that uniformly charges the surface of the photosensitive drum, and a development device 110.

In the present embodiment, a process cartridge 111 integrally configuring the photosensitive drum 107 and process portions of the charging roller 109 acting on the photosensitive drum 107 and the development device 110 is provided.

The sheet feeding apparatus 103 includes a sheet cassette 1 as an accommodation portion capable of accommodating a large number of sheets S and a feeding roller 103A provided above the sheet cassette 1. The feeding roller 103A feeds the sheet S accommodated in the sheet cassette 1.

The sheet cassette 1 includes a cassette body 1A (sheet accommodation portion) that accommodates the sheet S, a sheet supporting plate 6, and a separating member 101.

The sheet supporting plate 6 is a plate on which the sheet S is stacked and is freely rotatingly held with respect to the cassette body 1A by using a spindle 50*a* as a fulcrum and energized toward the feeding roller 103A by a coil spring 51. By pushing up the sheet supporting plate 6 in the direction of the feeding roller 103A by the coil spring 51, the sheet S stacked on the sheet supporting plate 6 is pushed up toward the feeding roller 103A.

The separating member 101 separates the sheet S sent by the feeding roller 103A one by one.

<Image Forming Operation>

Next, an image forming operation of the image forming apparatus 100 configured as described above will be described. First, the surface of the photosensitive drum 107 is uniformly charged by the charging roller 109 in advance. Then, the rotating photosensitive drum 107 is irradiated with laser light from a laser scanner 122 provided in the apparatus body 2 based on an image signal from a host computer (not illustrated). Accordingly, an electrostatic latent image is formed on the surface of the photosensitive drum 107.

Next, the electrostatic latent image on the surface of the photosensitive drum 107 is developed by toner on the development device 110 and a toner image is formed on the photosensitive drum 107.

On the other hand, the feeding roller 103A starts to rotate in predetermined timing and simultaneously therewith, the sheet supporting plate (stacking member) 6 energized to the feeding roller side is swung upward by a force of the coil spring 51. As a result, a tip portion of the sheet S stacked on the sheet supporting plate 6 is pressed against the feeding roller 103A with a predetermined force. The feeding roller 103A is controlled to rotate counterclockwise only during feeding and feeds the pressed sheet S by a frictional force of the feeding roller 103A.

If a plurality of sheets S on the sheet supporting plate 6 is fed, only the topmost sheet S is separated by the action of the separating member 101. The topmost sheet is transported downstream.

Next, the topmost sheet S separated by the separating member 101 as described above is sent to a resist unit 105 to correct the sheet S for skew feeding. Then, the sheet S is transported to a transfer portion 108 configured by the photosensitive drum 107 and the transfer roller 106 through the resist unit 105.

In the transfer portion 108, a toner image formed on the photosensitive drum 107 is transferred to the sheet S by being electrically attracted by the transfer roller 106.

The sheet S to which the toner image has been transferred is then transported to a fixing unit 115 configured by a heating unit 113 and a pressure roller 114 by a transport belt 104. In the fixing unit 115, the toner image is fixed to the sheet S by heating and pressure. Then, the sheet S is discharged onto a discharge tray 121 on the top surface of the apparatus body by a pair of intermediate discharge rollers 118 and a pair of discharge rollers 119.

<Configuration of the Cassette Body>

Figure 2:
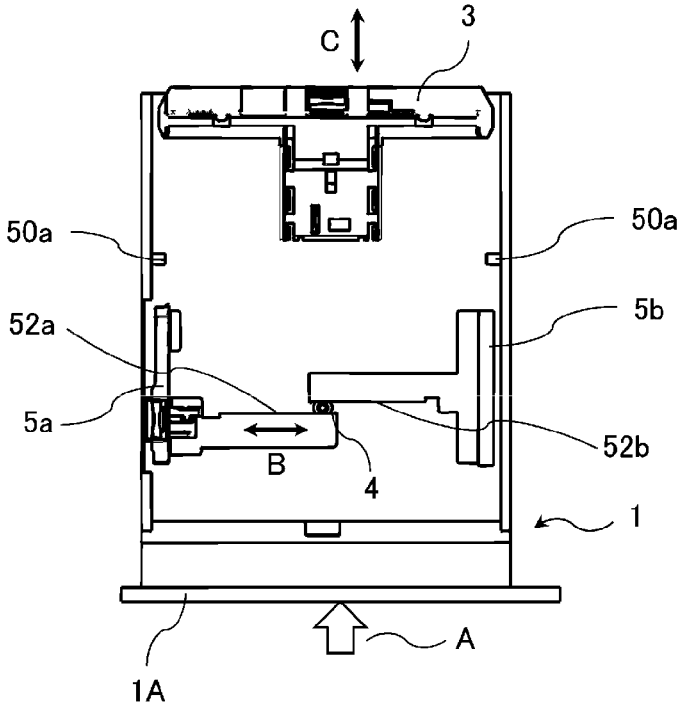
FIG. 2 is a schematic plan view of a sheet cassette according to the first embodiment.

The configuration of the cassette body 1A will be described using FIG. 2. FIG. 2 is a schematic plan view of a sheet cassette according to the first embodiment.

The sheet cassette 1 includes the cassette body (stacking unit) 1A that accommodates the sheets S of various sizes, a pair of side end regulating members 5*a*, 5*b* (side end regulating plate) that regulates a side end position of the sheet S, and a rear end regulating member 3 (rear end regulating plate) that regulates a rear end position (end position) of the sheet S. The side end regulating members 5*a*, 5*b* and the rear end regulating member 3 are arranged such that a swinging operation of the sheet supporting plate 6 (see FIG. 1) is not affected.

When the sheets S of various sizes are accommodated in the cassette body 1A, the side end position of the sheet S is regulated by causing the side end regulating members 5*a*, 5*b* to abut on the side end of the sheet S. Also, the rear end position of the sheet S is regulated by causing the rear end regulating member 3 to abut on the rear end of the sheet S. Accordingly, the sheet S can be accommodated in a positioned state.

To feed the sheet S, the sheet cassette 1 is inserted into the apparatus body 2 from an arrow A direction in FIG. 2. When the sheet cassette 1 is inserted, the sheet supporting plate 6 illustrated in FIG. 1 is pushed upward around the spindle 50*a* by the coil spring 51. Accordingly, the sheer S positioned by the side end regulating members 5*a*, 5*b* and the rear end regulating member 3 is pressed against the feeding roller 103A (see FIG. 1). The sheet S pressed against the feeding roller 103A in this manner is sent one by one by the feeding action of the feeding roller 103A to be fed to the image forming portion 102.

As illustrated in FIG. 2, rack teeth 52*a*, 52*b* are included in lower portions of the pair of side end regulating members 5*a*, 5*b* respectively. The rack teeth 52*a*, 52*b* are extended in the same direction as a width direction (arrow B direction), which is the direction of movement of the side end regulating members 5*a*, 5*b*. The rack teeth 52*a*, 52*b* freely move in the width direction by being guided by a guide groove (not illustrated) provided in the arrow B direction at the bottom of the cassette body 1A.

Each of the rack teeth 52*a*, 52*b* meshes with a pinion 4 provided freely rotatingly in the center at the bottom of the cassette body 1A.

Accordingly, if one of the side end regulating members 5*a*, 5*b* is moved in the width direction, the other of the side end regulating members 5*a*, 5*b* moves in the opposite direction of the one of the side end regulating members 5*a*, 5*b* simultaneously therewith with the action of the pinion 4 and the rack teeth 52*a*, 52*b*. By moving both of the side end regulating members 5*a*, 5*b* in the width direction simultaneously by moving one of the side end regulating members 5*a*, 5*b* as described above, both of the side end regulating members 5*a*, 5*b* are caused to abut on the side end of the sheet S stacked on the sheet supporting plate 6. Accordingly, positioning of the sheet S in the width direction can be performed easily.

The rear end regulating member 3 freely moves in the feeding direction (first direction) and the opposite direction thereof (second direction) by being guided by a guide groove (not illustrated) provided in an arrow C direction at the bottom of the cassette body 1A.

<Overall Configuration of a Rear End Regulating Member (Regulating Unit)>

Figure 3:
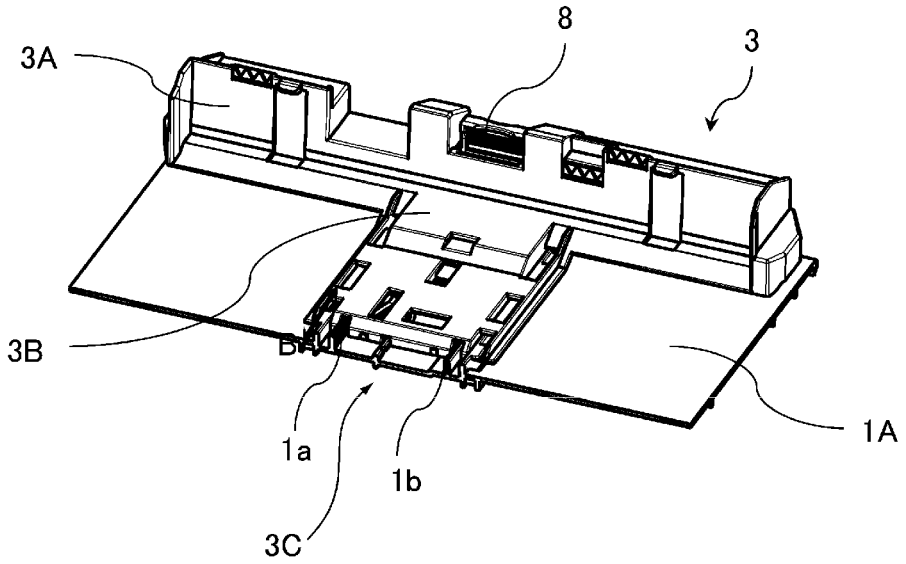
FIG. 3 is a perspective view illustrating the configuration of a rear end regulating member according to the first embodiment.

The overall configuration of the rear end regulating member 3 will be described using FIG. 3. FIG. 3 is a perspective view illustrating the configuration of the rear end regulating member 3 according to the first embodiment.

Figure 4:
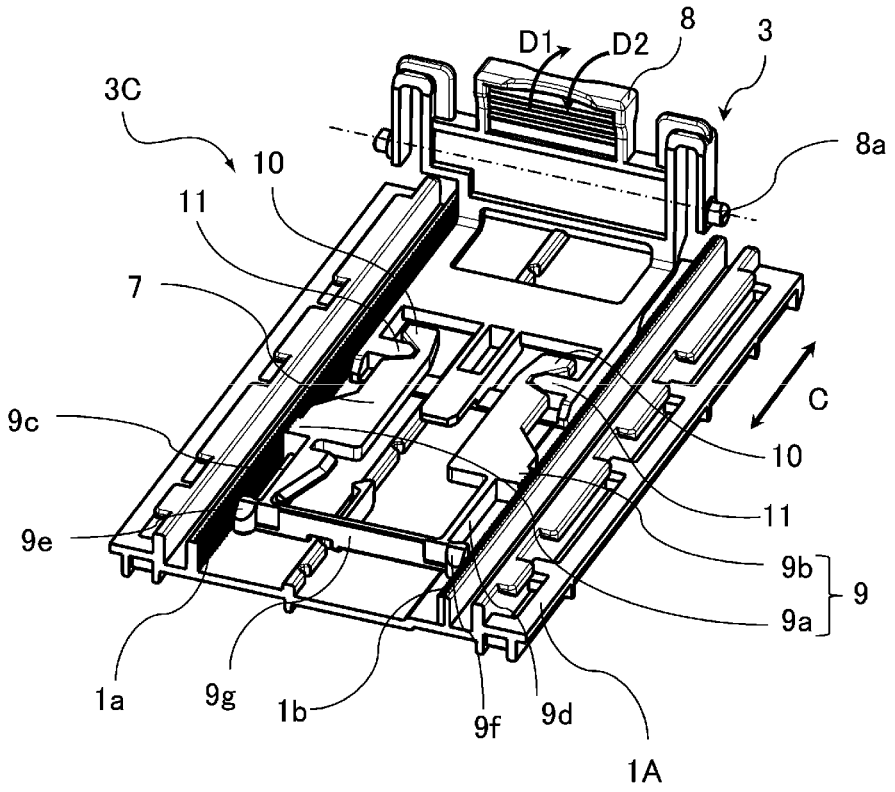
FIG. 4 is a perspective view illustrating a holding mechanism portion of the rear end regulating member according to the first embodiment.

As illustrated in FIG. 3, the rear end regulating member 3 has a body portion (abutting portion) 3A, a slide portion 3B, and a holding mechanism portion 3C (see FIG. 4). The body portion 3A is a member abutting on the rear end of the sheet S and the slide portion 3B is a member configured to be slidable by installing the body portion 3A vertically. The holding mechanism portion 3C is a member that holds the rear end regulating member 3 in a predetermined position by being engaged with the cassette body 1A by means of engaging portions 9*a*, 9*b* described later.

The rear end regulating member 3 includes an operation member 8. The operation member 8 has a rotating portion (swinging portion) rotatably (swingably) provided around a fulcrum (first swinging center) 8*a* by being operated by the user. The operation member 8 is movably configured by operating the rear end regulating member 3 and disengaging the engaging portions 9*a*, 9*b* from the cassette body 1A by a switching surface described later. When the engaging portions 9*a*, 9*b* are disengaged from the cassette body 1A by a disengagement operation of the operation member 8, the rear end regulating member 3 becomes movable. Accordingly, the position of the rear end regulating member 3 can be changed. After a movement operation of the rear end regulating member 3, the engaging portions 9*a*, 9*b* are engaged with the cassette body 1A again. Accordingly, the position of the rear end regulating member 3 can be held.

<Holding Mechanism Portion>

The holding mechanism portion 3C of the rear end regulating member 3 and the cassette body 1A will be described using FIGS. 4 and 5. FIG. 4 is a perspective view illustrating a holding mechanism portion of the rear end regulating member according to the first embodiment. FIG. 5 is a diagram illustrating the holding mechanism portion of the rear end regulating member according to the first embodiment, FIG. 5A is a plan view of the rear end regulating member, FIG. 5B is a b portion enlarged view of FIG. 5A, FIG. 5C is a c portion enlarged view of FIG. 5A, and FIG. 5D is a sectional view of the holding mechanism portion.

As illustrated in FIG. 4, the holding mechanism portion 3C includes rack tooth rows 1*a*, 1*b* (engaged portions) formed in the cassette body 1A and arranged along the direction of movement of the rear end regulating member 3, a holding member (engaging member) 7, and an operation member 8. As will be described later, a tooth row (engaging portion) 9 and a V-shaped groove 10 (operated shape portion) are formed in the holding member 7 and a convex (mountain-shaped cross-section) protruded portion 11 (operating shape portion) is formed in the operation member 8.

Figure 5A:
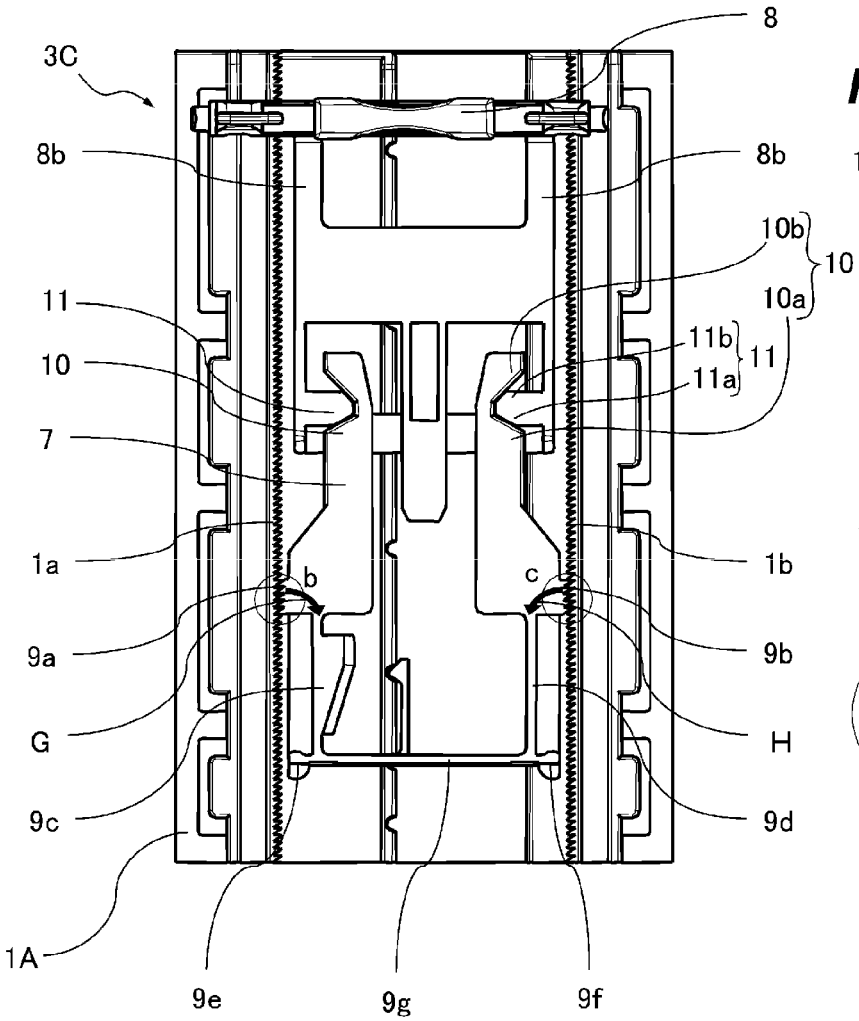
FIG. 5A is a diagram illustrating the holding mechanism portion of the rear end regulating member according to the first embodiment.
Figure 5B:
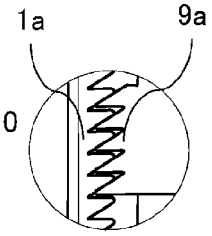
FIG. 5B is a diagram illustrating the holding mechanism portion of the rear end regulating member according to the first embodiment.
Figure 5C:
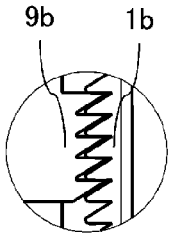
FIG. 5C is a diagram illustrating the holding mechanism portion of the rear end regulating member according to the first embodiment.
Figure 5D:
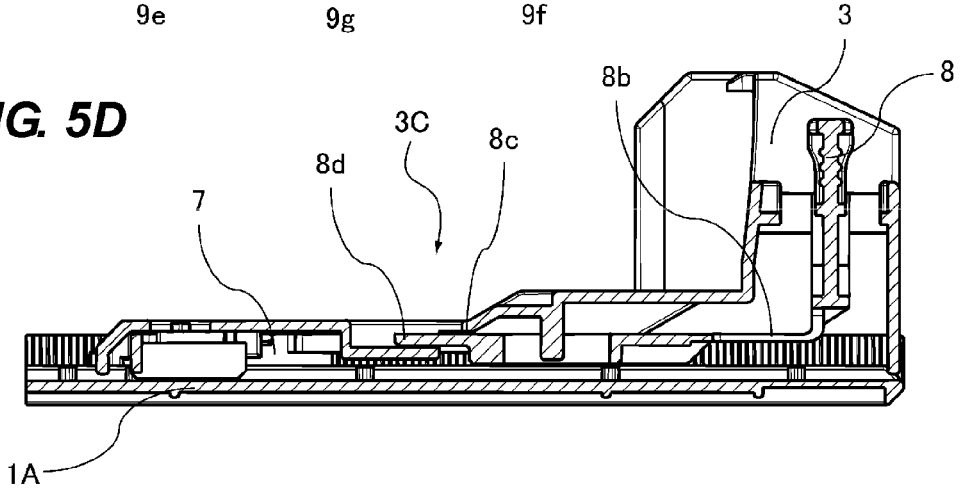
FIG. 5D is a diagram illustrating the holding mechanism portion of the rear end regulating member according to the first embodiment.

As illustrated in FIG. 5A, the holding member 7 has a structure configured by two members that are substantially symmetrical when viewed from above. In FIG. 5A, tooth rows as the engaging portions 9*a*, 9*b* are formed on outer ends below the holding member 7 to engage with the rack tooth rows 1*a*, 1*b* of the cassette body 1A.

In FIG. 5A, a concave (V-shaped cross-section) V-shaped groove 10 is formed on the outer side above the holding member 7. In the V-shaped groove 10, as will be described later, the small size regulating direction on the lower side of the drawing is a first switching surface (first disengaged surface) 10*a* and the large size regulating direction on the upper side of the drawing is a first switching surface (second disengaged surface) 10*b*. The first switching surfaces 10*a*, 10*b* (abutted surfaces) as a pair of slopes are configured to be able to abut on second switching surfaces (first disengaged surface, second disengaged surface) 11*a*, 11*b* as a pair of slopes of the convex protruded portion 11 configured integrally with the operation member 8 and linked by a thin portion 8*b* respectively. That is, the second switching surfaces 11*a*, 11*b* function as disengaging portions that disengage the engagement of the tooth rows 9*a*, 9*b* (engaging portions) of the holding member 7 and the tooth rows 1*a*, 1*b* (engaged portions) of the cassette body 1A. More specifically, the second switching surfaces 11*a*, 11*b* move the tooth rows 9*a*, 9*b* from an engagement position where engaged with the tooth rows 1*a*, 1*b* to a disengagement position where disengaged from the tooth rows 1*a*, 1*b*. In this case, the direction in which the tooth rows 9*a*, 9*b* move is a direction perpendicular to the direction of movement (C direction) of the rear end regulating member 3 and the horizontal direction (direction perpendicular to the C direction).

Next, the procedure for moving the protruded portion 11 linked to the operation member 8 and rotating the holding member 7 while the protruded portion 11 abuts on the V-shaped groove 10 by operating the operation member 8, as a result, the holding member 7 and the rack tooth row 1*a*, 1*b* being disengaged will be described in detail.

As illustrated in FIGS. 4 and 5, the engaging portions 9*a*, 9*b* provided on side ends in two directions of the holding member 7 are tooth rows configured by a plurality of triangular teeth. The engaging portions 9*a*, 9*b* are engaged with the rack tooth rows 1*a*, 1*b* in the engagement position. The rack tooth rows 1*a*, 1*b* are provided at the bottom of the cassette body 1A and configured by triangular teeth. If the engaging portions 9*a*, 9*b* and the rack tooth rows 1*a*, 1*b* are engaged in this configuration in a mutually horizontal direction, the rear end regulating member 3 is held (fixed) in a set position according to the sheet size.

As described above, the tooth rows of the engaging portions 9*a*, 9*b* and the rack tooth rows 1*a*, 1*b* are triangular teeth. Accordingly, a mechanically high holding strength can be ensured. Then, pitches of the engaging portions 9*a*, 9*b* and the rack tooth rows 1*a*, 1*b* can be made smaller so that the set position of the rear end regulating member 3 can be fine-tuned.

The engaging portions 9*a*, 9*b* each have tooth shapes set mutually in opposite directions. That is, as illustrated in FIG. 5B, the engaging portion 9*a* has the shape of teeth formed on the side regulated when the rear end regulating member 3 is moved to hold a small-size sheet. On the other hand, as illustrated in FIG. 5C, the engaging portion 9*b* has a substantially vertical surface formed on the side regulated when the rear end regulating member 3 is moved to hold a large-size sheet. Thus, a large resistance force is generated when the rear end regulating member 3 is moved in both of the large size regulating direction and the small size regulating direction.

Thus, when a force in the large size regulating direction or the small size regulating direction is received by the rear end regulating member 3, substantially vertical surfaces of the engaging portion 9*a* and the rack tooth row 1*a* or the engaging portion 9*b* and the rack tooth row 1*b* are pressed.

Therefore, when a force in the large size regulating direction or the small size regulating direction is received by the rear end regulating member 3, the respective substantially vertical surfaces of the engaging portions 9*a*, 9*b* and the rack tooth rows 1*a*, 1*b* are pressed. Then, the rear end regulating member 3 can receive the force applied thereto and the rear end regulating member 3 achieves high holding power.

Also in the present embodiment, the engaging portions 9*a*, 9*b* and the rack tooth rows 1*a*, 1*b* are engaged in the horizontal direction. Accordingly, even if the rear end regulating member 3 receives a force in the large size regulating direction or the small size regulating direction and the engaging portions 9*a*, 9*b* are deformed in the vertical direction, the engagement direction and the deformation direction are in an orthogonal relationship. The structure in which the engagement direction and the deformation direction are orthogonal to each other is a structure resistant to deformation and thus, the rear end regulating member 3 achieves high holding power.

The engaging portion 9*a* is configured to be deformable (swingable) in an arrow G direction using the root of an arm portion 9*c* extending from the engaging portions 9*a* as a rotation fulcrum (second swinging fulcrum) 9*e*. Similarly, the engaging portion 9*b* is configured to be deformable (swingable) in an arrow H direction using the root of an arm portion 9*d* extending from the engaging portions 9*b* as a rotation fulcrum (second swinging fulcrum) 9*f*.

In addition, an elastic portion 9*g* is provided between the rotation fulcrums 9*e*, 9*f*. In this manner, the engaging portion 9*a* and the engaging portion 9*b* are integrated.

<Disengaging Mechanism>

Figure 6A:
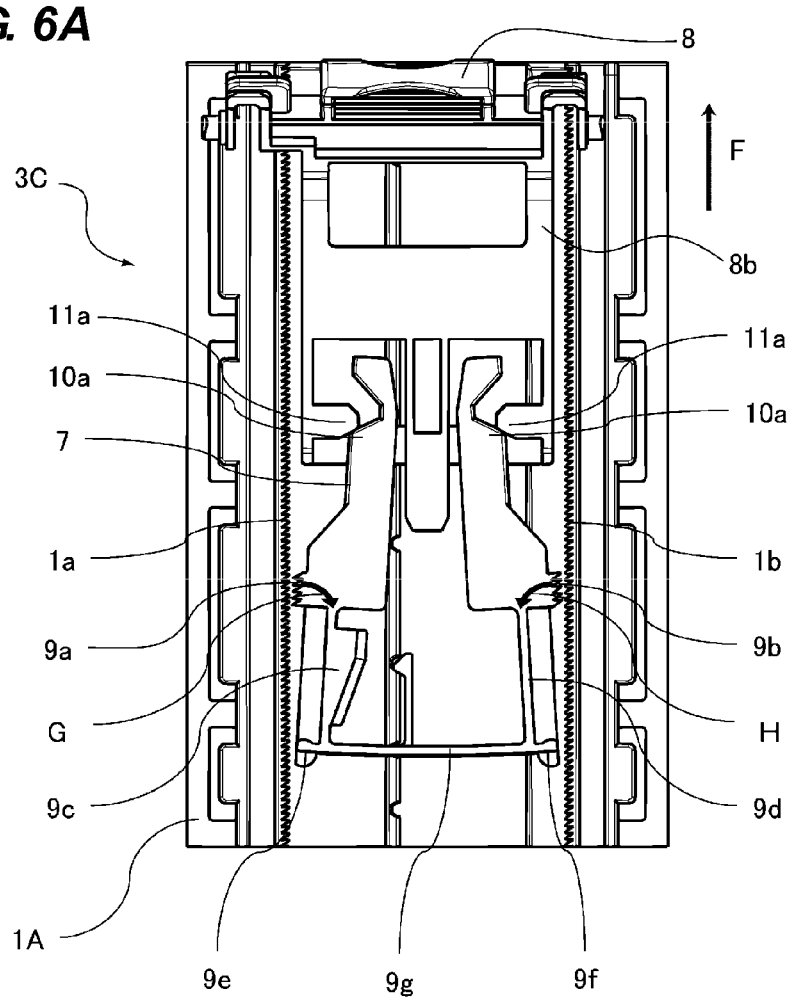
FIG. 6A is a diagram illustrating a disengaged state by operating an operation portion of the holding mechanism portion according to the first embodiment to rotate in a large size regulating direction.
Figure 6B:
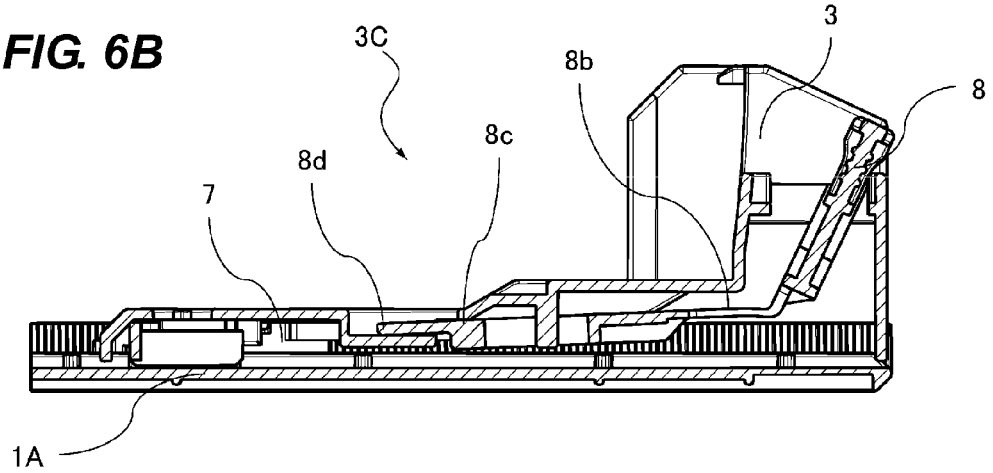
FIG. 6B is a diagram illustrating the disengaged state by operating the operation portion of the holding mechanism portion according to the first embodiment to rotate in the large size regulating direction.
Figure 7A:
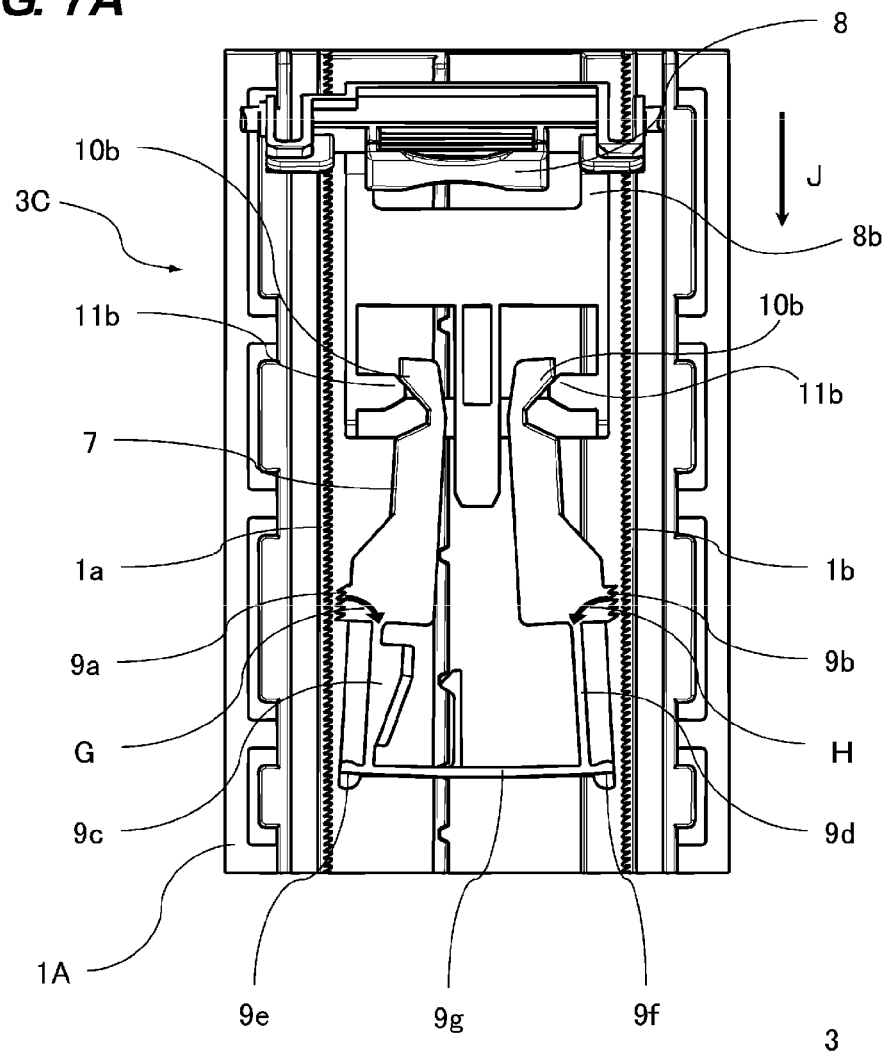
FIG. 7A is a diagram illustrating the disengaged state by operating the operation portion of the holding mechanism portion according to the first embodiment to rotate in a small size regulating direction.
Figure 7B:
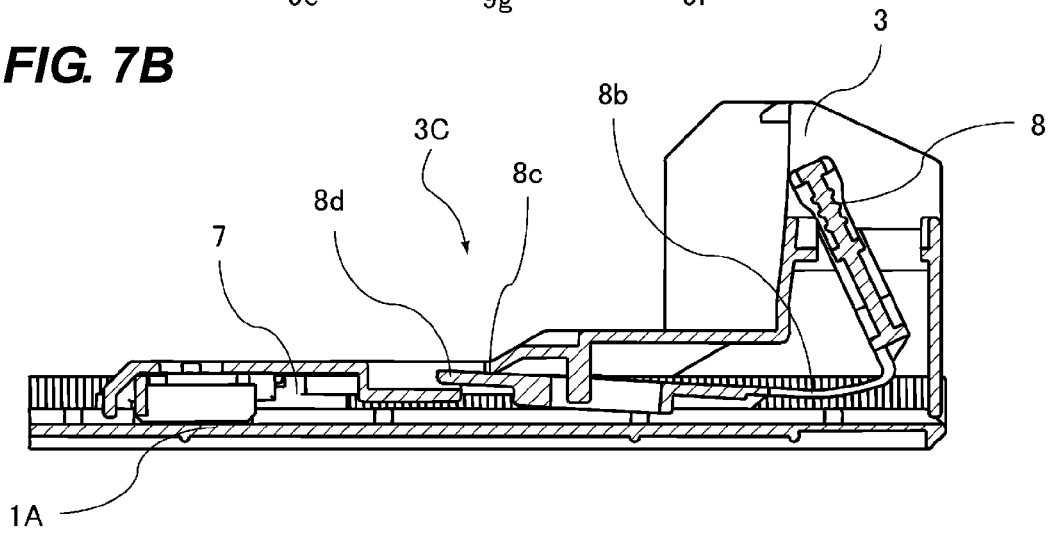
FIG. 7B is a diagram illustrating the disengaged state by operating the operation portion of the holding mechanism portion according to the first embodiment to rotate in the small size regulating direction.

Next, details of the mechanism by which the rear end regulating member 3 and the cassette body 1A are disengaged will be described using FIGS. 3 to 7. FIG. 6 is a diagram illustrating a disengaged state by operating the operation portion of the holding mechanism portion according to the first embodiment to rotate in the large size regulating direction, FIG. 6A is a plan view of the holding mechanism portion, and FIG. 6B is a sectional view of the holding mechanism portion. FIG. 7 is a diagram illustrating a disengaged state by operating the operation portion of the holding mechanism portion according to the first embodiment to rotate in the small size regulating direction, FIG. 7A is a plan view of the holding mechanism portion, and FIG. 7B is a sectional view of the holding mechanism portion.

The operation member 8 is provided above the body portion 3A of the rear end regulating member 3 illustrated in FIG. 3. The operation member 8 is also provided rotatably, as illustrated in FIG. 4, in an arrow D1 direction (first direction) and an arrow D2 direction (second direction) around a spindle 8*a* (rotation axis) arranged in a direction substantially perpendicular to the direction of movement of the rear end regulating member 3.

As illustrated in FIGS. 4 to 7, the concave first switching surface 10*a* in a V shape extending toward the outer side is formed in the holding member 7. On the other hand, the convex second switching surface 11*a* in a V shape is provided on bottom ends of the operation member 8. The first switching surface 10*a* of the holding member 7 and the second switching surface 11*a* of the operation member 8 loosely fit into each other.

A thin portion (elastic portion) 8*b* elastically deformed by a rotating portion of the operation member 8 being rotated is provided between the operation member 8 and the second switching surface 11*a* and the operation member 8 and the second switching surface 11*a* are linked by the thin portion 8*b*. The thin portion 8*b* is elastically deformably provided by being thinner than other portions of the operation member 8. The thin portion 8*b* is also provided between the spindle 8*a* and the second switching surface 11*a*. Also, as illustrated in FIG. 5D, movement regulating portions 8*c*, 8*d* that regulate movement in a direction perpendicular to the direction of movement of the second switching surface 11*a* are provided in the center on the bottom end of the operation member 8. The movement regulating portions 8*c*, 8*d* are provided in the rear end regulating member 3 to regulate movement of a portion of the operation member 8 in a thickness direction of a sheet.

In the present embodiment, according to the above configuration, when the second switching surface 11*a* of the operation member 8 and the first switching surface 10*a* of the holding member 7 move relatively, the engaging portions 9*a*, 9*b* and the rack tooth rows 1*a*, 1*b* are disengaged.

When, for example, the rear end regulating member 3 is moved in the large size regulating direction (arrow F direction) in FIG. 6A to accommodate the large-size sheet S, first the operation member 8 is pressed in the arrow F direction, which is the same direction as the direction of movement of the rear end regulating member 3. Then, the operation member 8 swings in the D1 direction using the spindle 8*a* illustrated in FIG. 4 as a fulcrum (state in FIG. 6).

Here, as illustrated in FIG. 6B, the movement in the up and down direction perpendicular to the arrow F direction is regulated by the movement regulating portions 8*c*, 8*d*. Thus, the thin portion 8*b* horizontally moves the second switching surface 11*a* of the protruded portion 11 in the convex V shape in the opposite direction of the arrow F direction while being elastically deformed. When the second switching surface 11*a* of the operation member 8 moves horizontally, the second switching surface 11*a* presses the first switching surface 10*a* of the holding member 7.

With the first switching surface 10*a* of the holding member 7 being pressed, as illustrated in FIG. 6, the engaging portions 9*a*, 9*b* of the holding member 7 rotate by using the roots of the arm portions 9*c*, 9*d* as the rotation fulcrums 9*e*, 9*f*. The engaging portions 9*a*, 9*b* rotate in the arrow G, H directions respectively. Then, the engaging portion 9*a* and the rack tooth row 1*a* and the engaging portion 9*b* and the rack tooth row 1*b* are disengaged so that the holding member 7 and the cassette body 1A are disengaged. At this point, as illustrated in FIG. 6A, the elastic portion 9*g* is elastically deformed.

As described above, the engaging portions 9*a*, 9*b* and the rack tooth rows 1*a*, 1*b* are disengaged simultaneously with an operation to turn over the operation member 8. Accordingly, when the set position is changed thereafter, the rear end regulating member 3 can easily be moved in the large size regulating direction.

If, after the movement of the rear end regulating member 3 is completed, pressing of the operation member 8 is released, the thin portion 8*b* and the elastic portion 9*g* are elastically deformed. Then, the engaging portions 9*a*, 9*b* and the rack tooth rows 1*a*, 1*b* return to an original state of engagement (see FIG. 5) so that the rear end regulating member 3 can be held in the set position.

Also, the operation member 8 similarly returns to an original posture due to the action of the thin portion 8*b* and the elastic portion 9*g*. Then, the home position of the operation member 8 is decided.

Next, when the rear end regulating member 3 is moved in the small size regulating direction (arrow J direction) in FIG. 7A to accommodate a small-size sheet, first the operation member 8 is pressed in the arrow J direction, which is the same direction as the direction of movement of the rear end regulating member 3. Then, the operation member 8 swings in the D2 direction using the spindle 8*a* illustrated in FIG. 4 as a fulcrum.

Here, as illustrated in FIG. 7B, the movement in the up and down direction perpendicular to the arrow F direction is regulated by the movement regulating portions 8*c*, 8*d*. Thus, the thin portion 8*b* horizontally moves the second switching surface 11*b* of the protruded portion 11 provided with the convex V shape in the opposite direction of the arrow J direction while being elastically deformed. When the second switching surface 11*b* of the operation member 8 moves horizontally, the second switching surface 11*b* presses the first switching surface 10*b* of the holding member 7.

When the first switching surface 10*b* of the holding member 7 is pressed, as illustrated in FIG. 7, the engaging portions 9*a*, 9*b* of the holding member 7 rotate by using the roots of the arm portions 9*c*, 9*d* as the rotation fulcrums 9*e*, 9*f*. The engaging portions 9*a*, 9*b* rotate in the arrow G, H directions respectively. Then, the engaging portion 9*a* and the rack tooth row 1*a* and the engaging portion 9*b* and the rack tooth row 1*b* are disengaged so that the holding member 7 and the cassette body 1A are disengaged. At this point, as illustrated in FIG. 7A, the elastic portion 9*g* is elastically deformed.

As described above, the engaging portions 9*a*, 9*b* and the rack tooth rows 1*a*, 1*b* are disengaged simultaneously with an operation to turn over the operation member 8. Accordingly, when the set position is changed thereafter, the rear end regulating member 3 can easily be moved in the small size regulating direction.

If, after the movement of the rear end regulating member 3 is completed, pressing of the operation member 8 is released, the thin portion 8*b* and the elastic portion 9*g* are elastically deformed. Then, the engaging portions 9*a*, 9*b* and the rack tooth rows 1*a*, 1*b* return to an original state of engagement (see FIG. 5) so that the rear end regulating member 3 can be held in the set position.

Similarly, the operation member 8 also returns to the original state due to the action of the thin portion 8*b* and the elastic portion 9*g*. Then, the home position of the operation member 8 is decided.

According to the present embodiment, as described above, regardless of the direction of both directions (arrow D1 and D2 directions) in which a pressing operation of the operation member 8 is performed, the engaging portion 9*a* moves in the same direction of the arrow G direction only and the engaging portion 9*b* moves in the same direction of the arrow H direction only. Thus, the engaging portions 9*a*, 9*b* and the rack tooth rows 1*a*, 1*b* are reliably disengaged.

Therefore, when the rear end regulating member 3 is moved, if a pressing operation of the operation member 8 is performed in the direction in which the rear end regulating member 3 should be moved, holding by the holding mechanism portion 3C is released. The rear end regulating member 3 is thereby made movable.

Also in the present embodiment, as illustrated in FIG. 5, the inclination angle of the first switching surface 10*a* on the engaging portions 9*a*, 9*b* side of the V-shaped groove 10 and the inclination angle on the opposite side of the engaging portions 9*a*, 9*b* of the first switching surface 10*b* are made different. Similarly, the inclination angle of the second switching surface 11*a* of the protruded portion 11 and the inclination angle of the second switching surface 11*b* are made different. Accordingly, the timing when the engaging portions 9*a*, 9*b* of the holding member 7 and the rack tooth rows 1*a*, 1*b* are disengaged can completely be aligned regardless of the operation direction of the rear end regulating member 3, improving operability.

The concrete magnitude of the angle depends on the sizes of the V-shaped groove 10, the protruded portion 11, and the holding member 7 and therefore, it is necessary to set an appropriate magnitude.

By providing an engaging portion and a switching surface on both sides of the holding mechanism portion 3C, integrating the engaging portion and the switching surface by an elastic portion, and providing a switching portion and a thin portion in an operation portion, as described above, a slimmed holding mechanism portion can be configured by an extremely small number of components. Therefore, operations in both directions of the large size regulating direction and the small size regulating direction and holding of a rear end regulating member can be enabled.

Accordingly, a sheet cassette can be made smaller in size by lowering the height of a holding portion without sacrificing operability of the rear end regulating member and assembling properties can be improved by reducing the number of components around the regulating member.

If, after the movement of the rear end regulating member is completed, a pressing operation of the operation portion is released, pressing of a V-shaped groove of a protruded portion is also released. Then, the operation portion also returns to an original state due to the action of the thin portion and the elastic portion and also deformation of the elastic portion is restored to its original state and therefore, plastic deformation of the elastic portion can be avoided and quality is stabilized.

In the present embodiment, an example in which the configuration of the holding mechanism portion 3C is applied to the rear end regulating member 3 is shown, but a similar configuration can also be applied to a side end regulating member.

In the present embodiment, an example in which the present invention is applied to the sheet cassette 1 is described, but the present invention should not be limited to such an example. That is, the present invention can be applied to a sheet stacking apparatus including a stacking unit on which sheets are stacked and a regulating unit that regulating the position of a sheet by abutting on ends of the sheet stacked on the stacking unit. For example, the present invention can be applied to a so-called manual sheet tray or an automatic document feeder (ADF).

Second Embodiment

The second embodiment of the present invention will be described. In the description of the second embodiment below, the description of content (configurations and operations) common to the first embodiment is omitted when appropriate.

<Overall Configuration of a Side End Regulating Member>

Figure 8A:
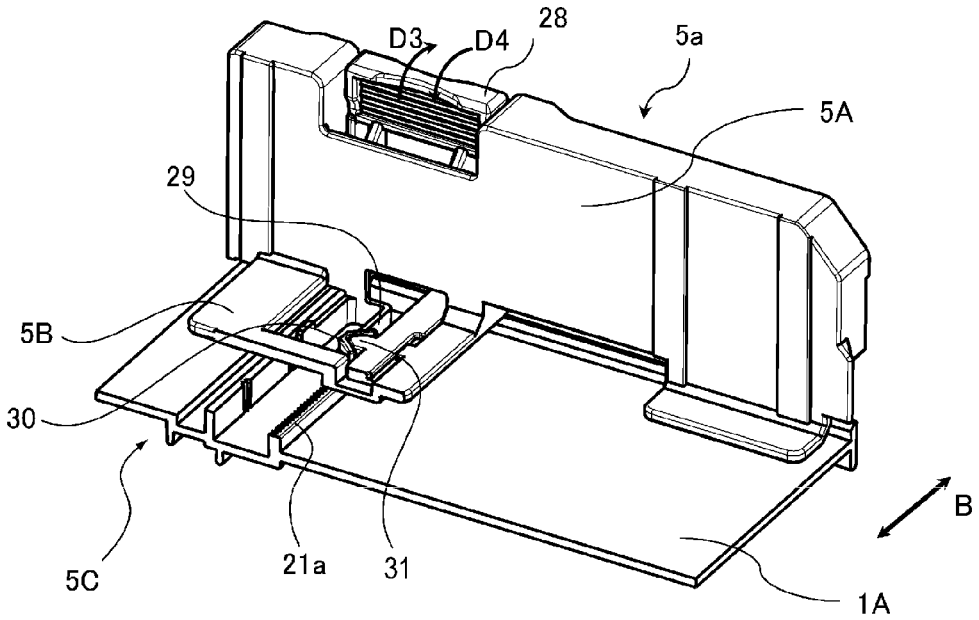
FIG. 8A is a perspective view illustrating the configuration of a side end regulating member according to a second embodiment.
Figure 8B:
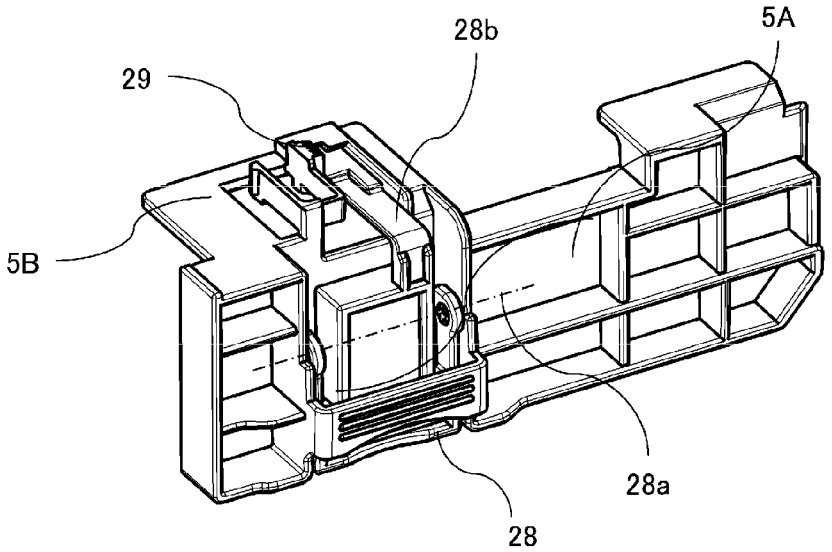
FIG. 8B is a perspective view illustrating the configuration of the side end regulating member according to the second embodiment.

The overall configuration of a side end regulating member 5*a* will be described using FIG. 8. FIG. 8 is a perspective view illustrating the configuration of a side end regulating member according to the second embodiment, FIG. 8A is a perspective view when the side end regulating member is viewed from above, and FIG. 8B is a perspective view when the side end regulating member is viewed from below.

As illustrated in FIG. 8, the side end regulating member 5*a* includes a body portion 5A that abuts on a side end of the sheet S, a slide portion 5B on which the body portion 5A is installed vertically, and a holding mechanism portion 5C that holds the side end regulating member 5*a* in a predetermined position (end position) by being engaged with the cassette body 1A by means of a holding member 29 described later. The holding mechanism portion 5C is formed of an engaged portion 21*a* made of a rack tooth row arranged along the direction of movement of the side end regulating member 5*a* formed in the cassette body 1A and an operation portion 28 and the holding member 29 provided in the side end regulating member 5*a*.

The operation portion 28 makes the side end regulating member 5*a* movable. That is, the side end regulating member 5*a* is made movable by a disengagement operation of the operation portion 28 to disengage the holding member 29 from the cassette body 1A. Accordingly, the set position of the side end regulating member 5*a* can be changed. After a movement operation of the side end regulating member 5*a*, the position of the side end regulating member 5*a* can be held by an engaging portion being engaged with the cassette body 1A again.

<Holding Mechanism Portion>

Figure 9:
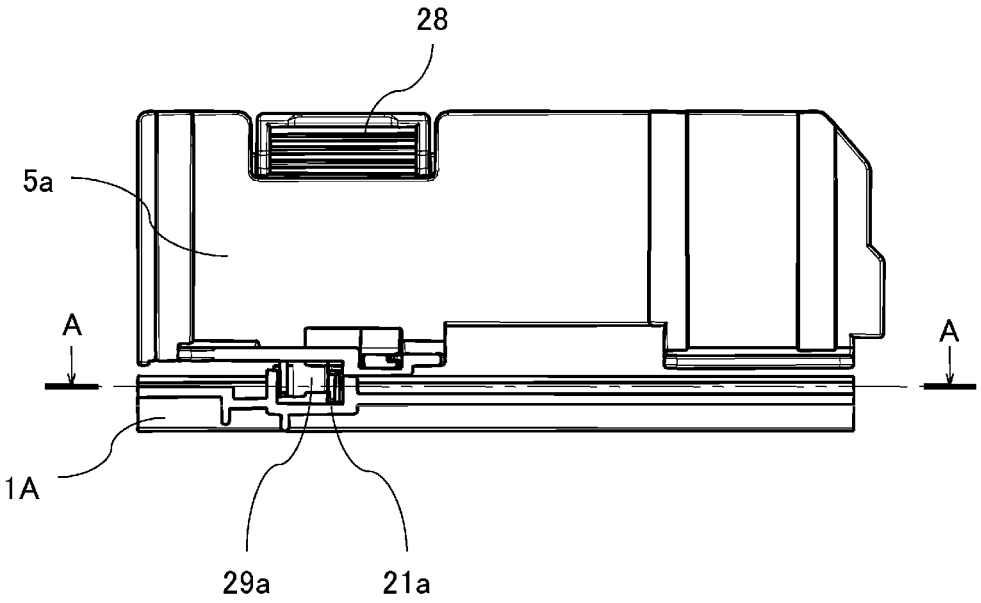
FIG. 9 is a front view illustrating the holding mechanism portion of the side end regulating member according to the second embodiment.
Figure 10A:
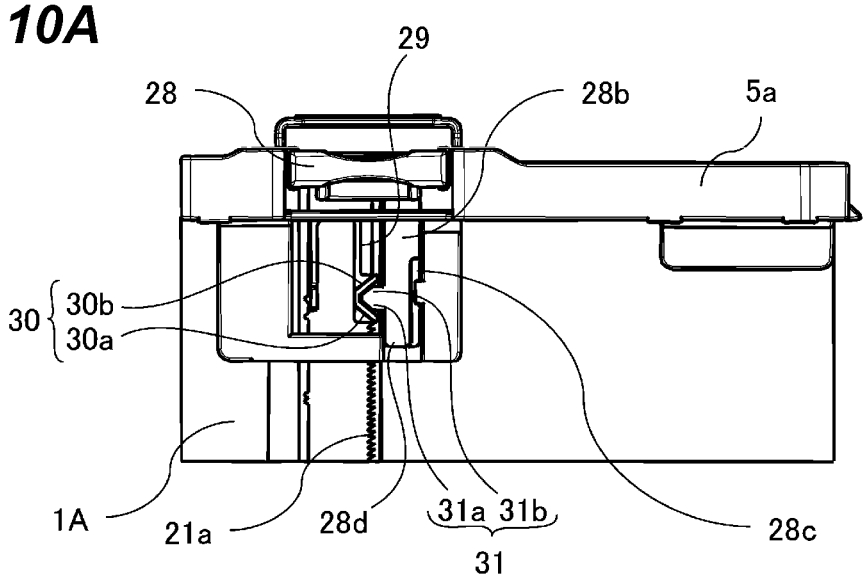
FIG. 10A is a diagram illustrating the holding mechanism portion of the side end regulating member according to the second embodiment.
Figure 10B:
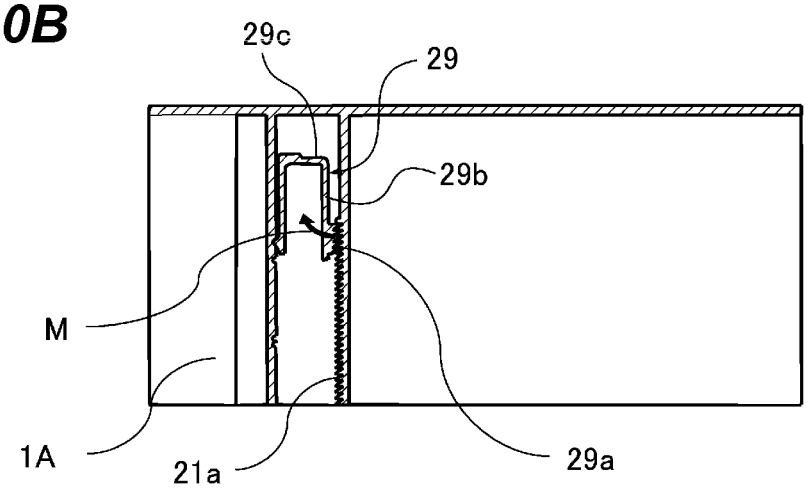
FIG. 10B is a diagram illustrating the holding mechanism portion of the side end regulating member according to the second embodiment.
Figure 10C:
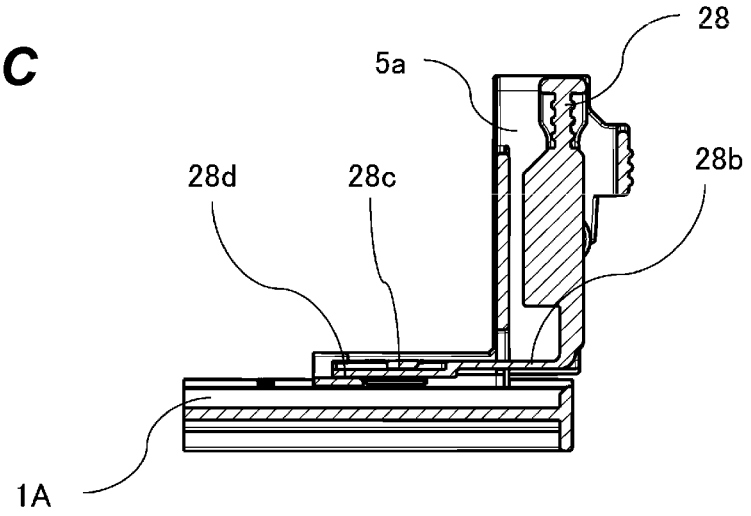
FIG. 10C is a diagram illustrating the holding mechanism portion of the side end regulating member according to the second embodiment.

The holding mechanism portion 5C of the side end regulating member 5*a* and the cassette body 1A will be described using FIGS. 9 and 10. FIG. 9 is a front view illustrating the holding mechanism portion of the side end regulating member according to the second embodiment. FIG. 10 is a diagram illustrating the holding mechanism portion of the side end regulating member according to the second embodiment, FIG. 10A is a top view of the side end regulating member, FIG. 10B is a horizontal sectional view (A-A sectional view of FIG. 9) of the holding mechanism portion, and FIG. 10C is a sectional view of the side end regulating member.

As illustrated in FIGS. 9 and 10, the holding member 29 provided in the side end regulating member 5*a* includes a tooth row 29*a* (engaging portion) formed of a plurality of triangular teeth on the side face. The tooth row 29*a* engages with the engaged portion 21*a* made of a rack tooth row provided at the bottom of the cassette body 1A. The engaged portion 21*a* made of a rack tooth row is formed of triangular teeth.

If the tooth row 29*a* provided in the holding member 29 is engaged with the engaged portion 21*a* made of a rack tooth row in a horizontal direction as described above, the side end regulating member 5*a* is held (fixed) in a set position according to the sheet size.

By adopting triangular teeth for teeth of the tooth row 29*a* and the engaged portion 21*a* made of a rack tooth row like in the present embodiment, a mechanically high holding strength can be ensured. As a result, pitches of the tooth row 29*a* and the engaged portion 21*a* made of a rack tooth row can be made smaller so that the set position of the side end regulating member 5*a* can be fine-tuned.

In the holding member 29, as illustrated in FIG. 10A, a concave (V-shaped cross-section) V-shaped groove 30 (operated shape portion) is formed. In the V-shaped groove 30, as will be described later, the small size regulating direction on the lower side of the drawing becomes a first switching surface 30*a* and the large size regulating direction on the upper side of the drawing becomes a first switching surface 30*b*. The first switching surfaces 30*a*, 30*b* (abutted surfaces) as a pair of slopes are configured to be able to abut on second switching surfaces (abutting surfaces) 31*a*, 31*b* as a pair of slopes of a convex protruded portion 31 (operating shape portion) configured integrally with the operation portion 28 and linked by a thin portion 28*b* respectively.

<Disengaging Mechanism>

Figure 11A:
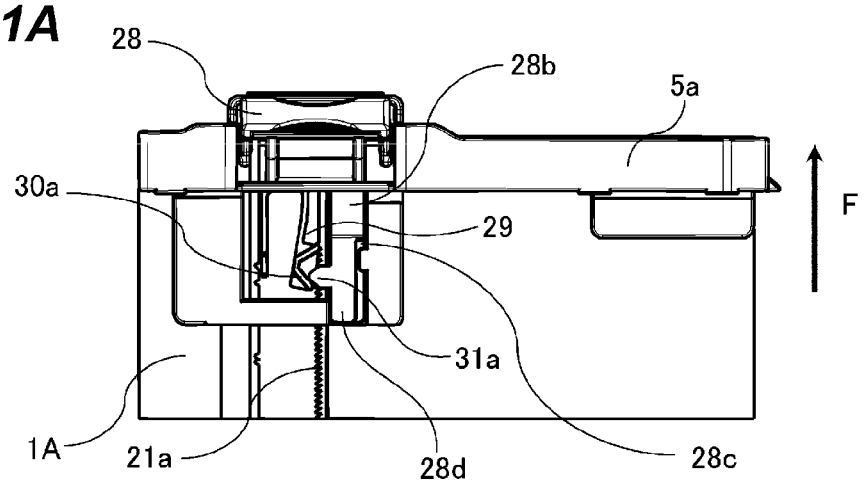
FIG. 11A is a diagram illustrating the disengaged state by operating the operation portion of the holding mechanism portion according to the second embodiment to rotate in the large size regulating direction.
Figure 11B:
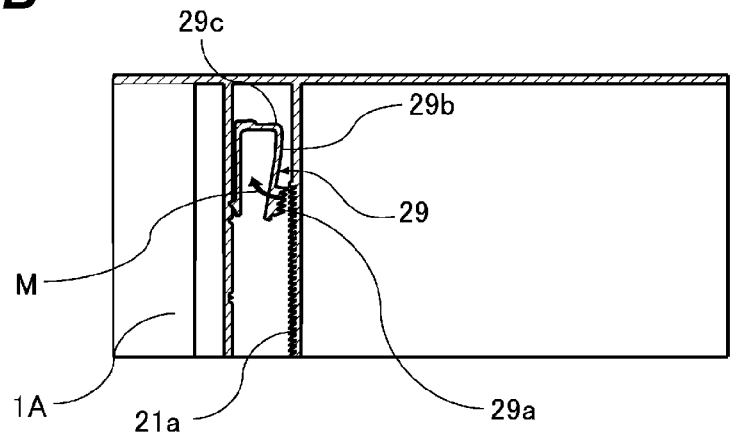
FIG. 11B is a diagram illustrating the disengaged state by operating the operation portion of the holding mechanism portion according to the second embodiment to rotate in the large size regulating direction.
Figure 11C:
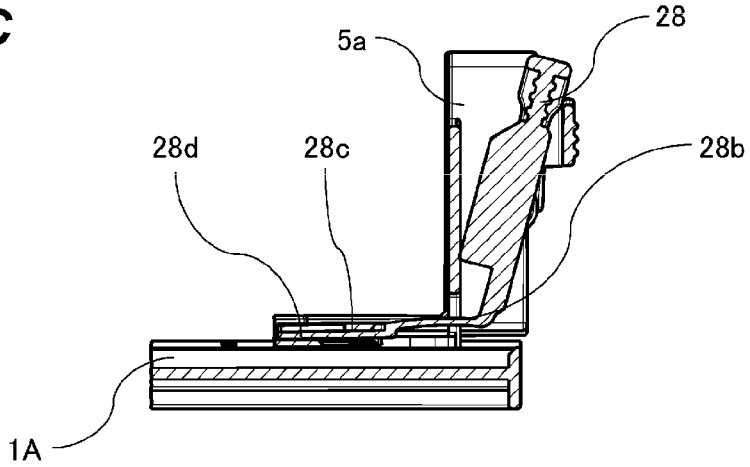
FIG. 11C is a diagram illustrating the disengaged state by operating the operation portion of the holding mechanism portion according to the second embodiment to rotate in the large size regulating direction.
Figure 12A:
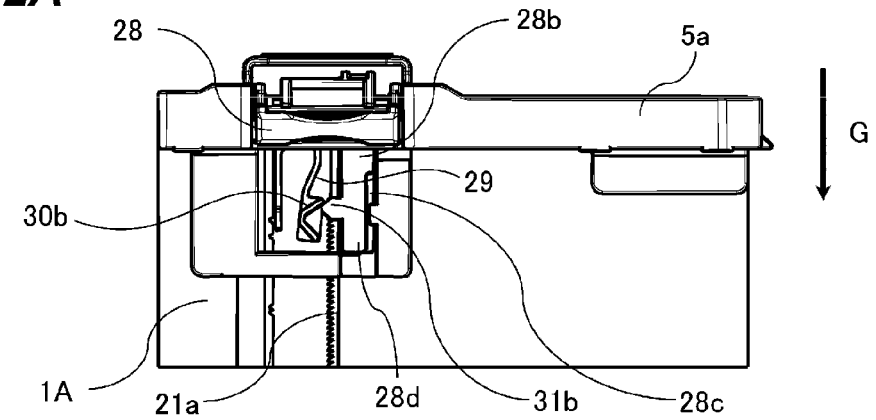
FIG. 12A is a diagram illustrating the disengaged state by operating the operation portion of the holding mechanism portion according to the second embodiment to rotate in the small size regulating direction.
Figure 12B:
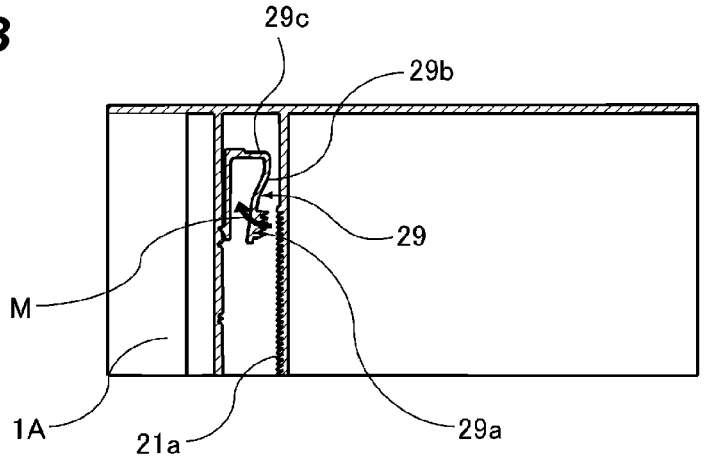
FIG. 12B is a diagram illustrating the disengaged state by operating the operation portion of the holding mechanism portion according to the second embodiment to rotate in the small size regulating direction.
Figure 12C:
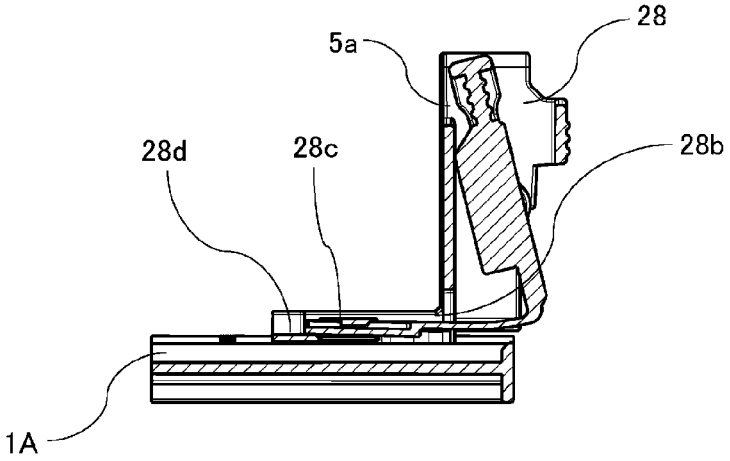
FIG. 12C is a diagram illustrating the disengaged state by operating the operation portion of the holding mechanism portion according to the second embodiment to rotate in the small size regulating direction.

Next, details of the mechanism by which the side end regulating member 5*a* and the cassette body 1A are disengaged will be described using FIGS. 8 to 12. FIG. 11 is a diagram illustrating the disengaged state by operating the operation portion of the holding mechanism portion according to the second embodiment to rotate in the large size regulating direction. FIG. 11A is a top view of the holding mechanism portion, FIG. 11B is a horizontal sectional view of the holding mechanism portion, and FIG. 11C is a sectional view illustrating the side end regulating member. FIG. 12 is a diagram illustrating the disengaged state by operating the operation portion of the holding mechanism portion according to the second embodiment to rotate in the small size regulating direction. FIG. 12A is a top view of the holding mechanism portion, FIG. 12B is a horizontal sectional view of the holding mechanism portion, and FIG. 12C is a sectional view illustrating the side end regulating member.

The operation portion 28 is provided, as illustrated in FIGS. 8 to 12, above the body portion 5A of the side end regulating member 5*a*. The operation portion 28 is also provided rotatably, as illustrated in FIG. 8B, in an arrow D3 direction and an arrow D4 direction illustrated in FIG. 8A around a spindle 28*a* (rotation axis) arranged in a direction substantially perpendicular to the direction of movement of the side end regulating member 5*a*.

The operation portion 28 includes, as illustrated in FIG. 10, a thin portion 28*b* that extends horizontally after drooping from the operation portion 28. The thin portion 28*b* has regulating portions 28*c*, 28*d* that regulate movement in the vertical direction formed therein. The thin portion 28*b* also has the convex (mountain-shaped cross-section) protruded portion 31 that loosely fits into the concave V-shaped groove 30 of the holding member 29.

Thus, with the protruded portion 31 integrated with the operation portion 28 and the V-shaped groove 30 formed near the holding member 29 abutting on each other and moving together, the holding member 29 of the side end regulating member 5*a* and the engaged portion 21*a* made of a rack tooth row of the cassette body 1A are disengaged simultaneously with an operation of the operation portion 28.

When, for example, the side end regulating member 5*a* is moved in the large size regulating direction (arrow F direction) in FIG. 11A to accommodate the large-size sheet S, first the operation portion 28 is pressed in the arrow F direction, which is the same direction as the direction of movement of the side end regulating member 5*a*. Then, the operation portion 28 swings in the D3 direction using the spindle 28*a* illustrated in FIG. 8B as a fulcrum (state in FIG. 11).

Here, as illustrated in FIG. 11, the movement in the up and down direction perpendicular to the arrow F direction is regulated by the movement regulating portions 28*c*, 28*d*. Thus, the thin portion 28*b* horizontally moves the second switching surface 31*a* of the protruded portion 31 in the convex V shape in the opposite direction of the arrow F direction while being elastically deformed. When the second switching surface 31*a* of the operation portion 28 moves horizontally, the second switching surface 31*a* presses the first switching surface 30*a* of the holding member 29.

With the first switching surface 30*a* of the holding member 29 being pressed, as illustrated in FIG. 11B, the tooth row 29*a* of the holding member 29 rotates in an arrow M direction by using a root 29*c* of an elastic portion 29*b* as a fixed end. Accordingly, the tooth row 29*a* of the holding member 29 and the engaged portion 21*a* made of a rack tooth row of the cassette body 1A are disengaged. Thereafter, when the side end regulating member 5*a* is moved in the large size regulating direction, the side end regulating member 5*a* can easily be moved thanks to the disengagement.

If, after the movement of the side end regulating member 5*a* is completed, pressing of the operation portion 28 is released, the thin portion 28*b* and the elastic portion 29*b* are elastically deformed. Then, the tooth row 29*a* of the holding member 29 and the engaged portion 21*a* made of a rack tooth row of the cassette body 1A return to an original state of engagement (see FIG. 10) so that the side end regulating member 5*a* can be held in the set position.

Also, the operation portion 28 similarly returns to an original state due to the action of the thin portion 28*b* and the elastic portion 29*b*. Then, the home position of the operation portion 28 is decided.

Next, when the side end regulating member 5*a* is moved in the small size regulating direction (arrow G direction) in FIG. 12A to accommodate the small-size sheet S, first the operation portion 28 is pressed in the arrow G direction, which is the same direction as the direction of movement of the side end regulating member 5*a*. Then, the operation portion 28 swings in the D4 direction using the spindle 28*a* illustrated in FIG. 8B as a fulcrum (state in FIG. 12).

Here, as illustrated in FIG. 12, the movement in the up and down direction perpendicular to the arrow G direction is regulated by the movement regulating portions 28*c*, 28*d*. Thus, the thin portion 28*b* horizontally moves the second switching surface 31*b* of the protruded portion 31 in the convex V shape in the opposite direction of the arrow F direction while being elastically deformed. When the second switching surface 31*b* of the operation portion 28 moves horizontally, the second switching surface 31*b* presses the first switching surface 30*b* of the holding member 29.

With the first switching surface 30*b* of the holding member 29 being pressed, as illustrated in FIG. 12B, the tooth row 29*a* of the holding member 29 rotates in the arrow M direction by using the root 29*c* of the elastic portion 29*b* as a fixed end. Accordingly, the tooth row 29*a* of the holding member 29 and the engaged portion 21*a* made of a rack tooth row of the cassette body 1A are disengaged. Thereafter, when the side end regulating member 5*a* is moved in the small size regulating direction, the side end regulating member 5*a* can easily be moved thanks to the disengagement.

If, after the movement of the side end regulating member 5*a* is completed, pressing of the operation portion 28 is released, the thin portion 28*b* and the elastic portion 29*b* are elastically deformed. Then, the tooth row 29*a* of the holding member 29 and the engaged portion 21*a* made of a rack tooth row of the cassette body 1A return to an original state of engagement (see FIG. 10) so that the side end regulating member 5*a* can be held in the set position.

Also, the operation portion 28 similarly returns to an original state due to the action of the thin portion 28*b* and the elastic portion 29*b*. Then, the home position of the operation portion 28 is decided.

According to the present embodiment, as described above, regardless of the direction of both directions (arrow D3 and D4 directions) in which a pressing operation of the operation portion 28 is performed, the tooth row 29*a* of the holding member 29 moves in the same direction of the arrow M direction only. Thus, the tooth row 29*a* and the engaged portion 21*a* made of a rack tooth row are reliably disengaged.

Therefore, when the side end regulating member 5*a* is moved, if a pressing operation of the operation portion 28 is performed in the direction in which the side end regulating member 5*a* should be moved, holding by the holding mechanism portion 5C is released. The side end regulating member 5*a* is thereby made movable.

By including the holding mechanism portion 5C configured integrally with the side end regulating member 5*a*, providing an engaging portion in the holding mechanism portion, and providing a switching portion and a thin portion in an operation portion, as described above, a slimmed holding mechanism portion can be configured by an extremely small number of components. In addition, operations in both directions of the large size regulating direction and the small size regulating direction and holding of a side end regulating member can be enabled.

Accordingly, a sheet cassette can be made smaller in size by lowering the height of a holding portion without sacrificing operability of the side end regulating member and assembling properties can be improved by reducing the number of components around the regulating member.

In addition, misregistration of the side end regulating member caused by rattling of components is eliminated in a state in which the side end regulating member is fixed, improving print precision.

If, after the movement of the side end regulating member is completed, a pressing operation of the operation portion is released, pressing of a V-shaped groove of a protruded portion is also released. Then, the operation portion also returns to an original state due to the action of the thin portion and the elastic portion and also deformation of the elastic portion is restored to its original state and therefore, plastic deformation of the elastic portion can be avoided and quality is stabilized.

In the present embodiment, an example in which the first switching surface 30*b* on the root 29*c* side of the elastic portion 29*b* of the V-shaped groove 30 and the first switching surface 30*a* on the opposite side of the root 29*c* of the elastic portion 29*b* have the same inclination angle, but the present embodiment is not limited to such an example. That is, the inclination angle of the first switching surface 30*b* on the root 29*c* side of the elastic portion 29*b* of the V-shaped groove 30 and the inclination angle of the first switching surface 30*a* on the opposite side of the root 29*c* of the elastic portion 29*b* are made different. Similarly, the inclination angle of the second switching surface 31*b* of the protruded portion 31 and the inclination angle of the second switching surface 31*a* are made different. Then, like in the first embodiment, the timing when the engaging portion and the engaged portion are disengaged can completely be aligned regardless of the operation direction of the regulating member. In such a case, operability is improved.

Also in the present embodiment, an example in which the present invention is applied to the side end regulating member 5*a* is shown, a similar configuration can also be applied to the rear end regulating member 3.

Third Embodiment

The third embodiment of the present invention will be described. In the description of the third embodiment below, the description of content (configurations and operations) common to the first embodiment and the second embodiment is omitted when appropriate.

<Overall Configuration of a Side End Regulating Member>

Figure 13:
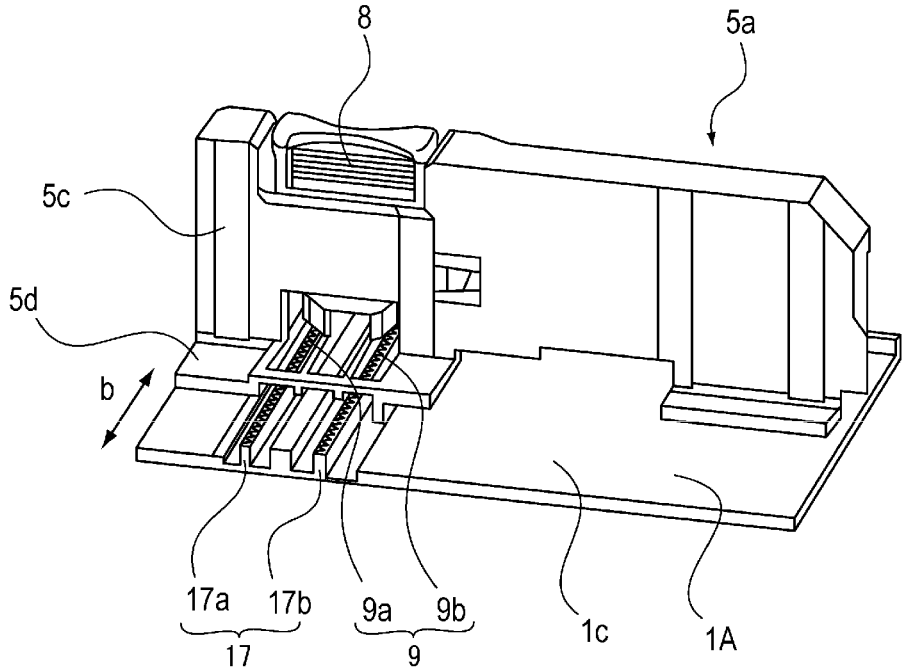
FIG. 13 is a perspective explanatory view illustrating a peripheral configuration of the regulating member according to a third embodiment.

Next, the overall configuration of the side end regulating member 5*a* (5*b*) will be described using FIG. 13. In the description that follows, the side end regulating member 5*a* of the side end regulating members 5*a*, 5*b* will representatively be described. FIG. 13 is a perspective view illustrating the configuration of the side end regulating member 5*a* (5*b*) provided in the sheet cassette 1. As illustrated in FIG. 13, the side end regulating member 5*a* (5*b*) has an abutting portion 5*c* abutting on the side end of the sheet S and a slide portion 5*d* provided perpendicularly to the abutting portion 5*c*.

Further, the engaging portions 9*a*, 9*b* constituting a tooth row 9 and rack tooth rows 17*a*, 17*b* to be an engaged portion 17 provided on a base plate 1*c* of the cassette body 1A are geared and engaged with each other. Accordingly, a holding mechanism portion that fixes and holds the side end regulating member 5*a* (5*b*) in a predetermined position with respect to the cassette body 1A is included.

Figure 16:
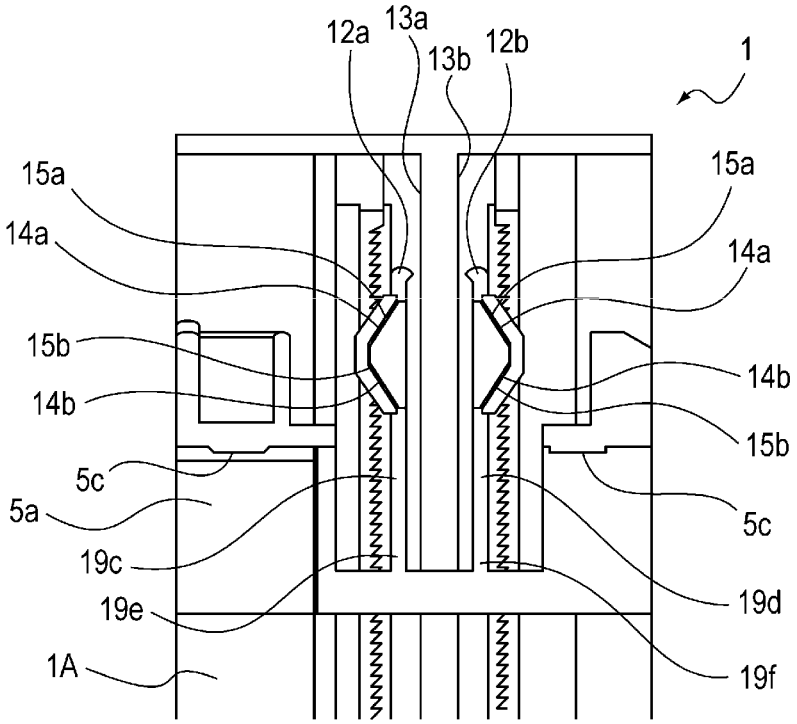
FIG. 16 is a K-K sectional view of FIG. 15 illustrating a state in which an engaging portion and an engaged portion are engaged by the operation portion of the regulating member according to the third embodiment being set to a home position.

Also, the operation member 8 that operates the side end regulating member 5*a* and makes the side end regulating member 5*a* movable by disengaging the tooth row 9 from the cassette body 1A by means of a pair of abutting surfaces 15*a*, 15*b* acting as switching surfaces and illustrated in FIG. 16. Then, when the tooth row 9 is disengaged from the cassette body 1A by a disengagement operation of the operation member 8, the side end regulating member 5*a* becomes movable and the set position of the side end of the sheet S can be changed. After a movement operation of the side end regulating member 5*a*, the position of the side end regulating member 5*a* can be held by the tooth row 9 being engaged with the cassette body 1A again.

Figure 18A:
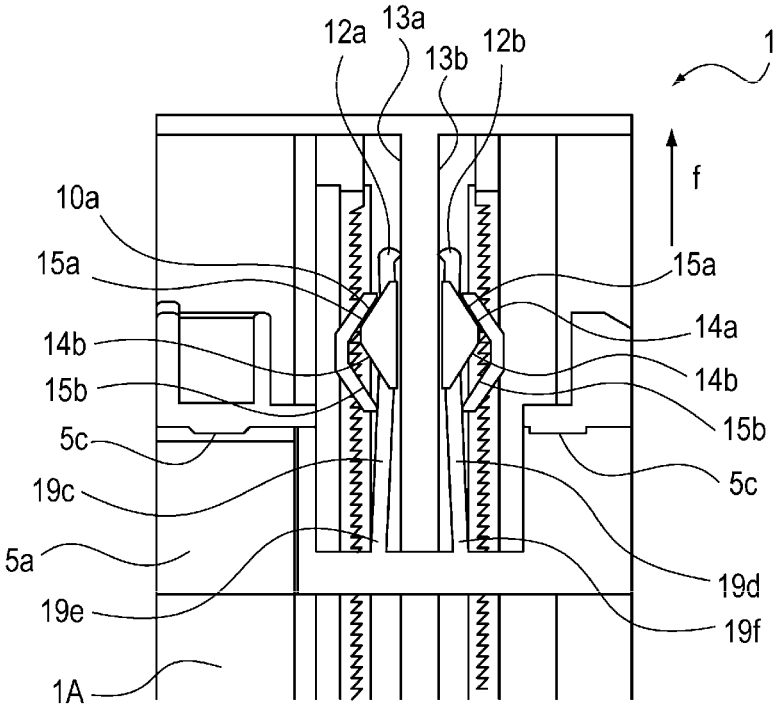
FIG. 18A is the K-K sectional view of FIG. 15 illustrating a state in which the engaging portion and the engaged portion are disengaged by operating the operation portion of the regulating member according to the third embodiment to rotate in a regulating direction of a large-size sheet.
Figure 18B:
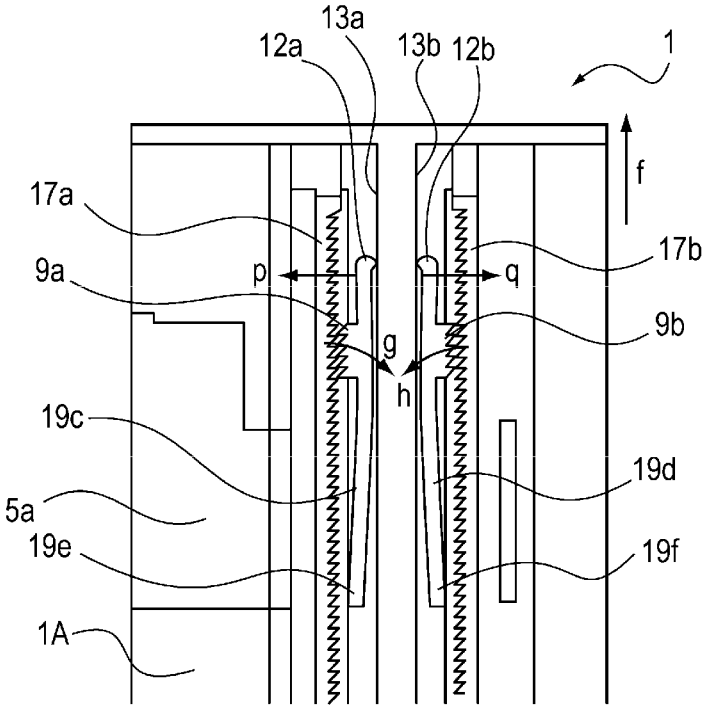
FIG. 18B is the L-L sectional view of FIG. 15 illustrating a state in which the engaging portion and the engaged portion are disengaged by operating the operation portion of the regulating member according to the third embodiment to rotate in the regulating direction of the large-size sheet.
Figure 19A:
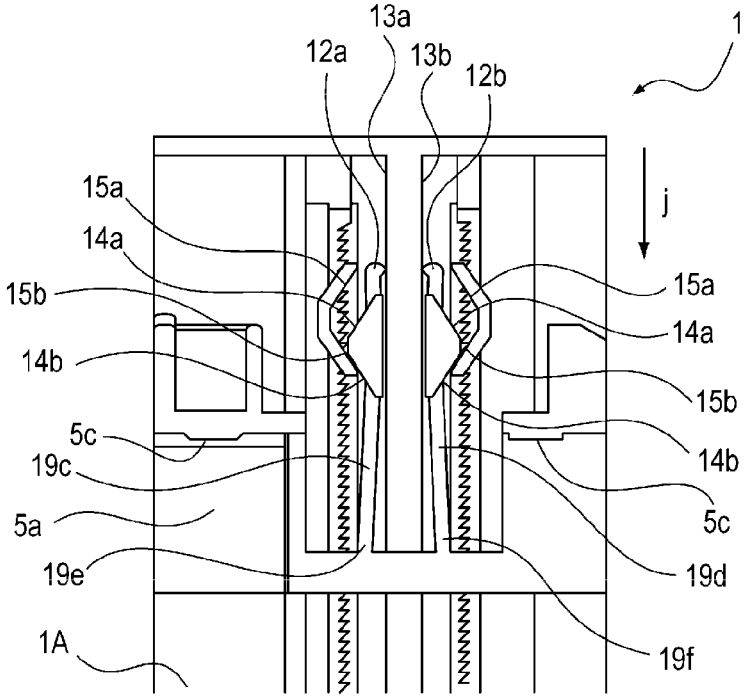
FIG. 19A is the K-K sectional view of FIG. 15 illustrating a state in which the engaging portion and the engaged portion are disengaged by operating the operation portion of the regulating member according to the third embodiment to rotate in the regulating direction of a small-size sheet.
Figure 19B:
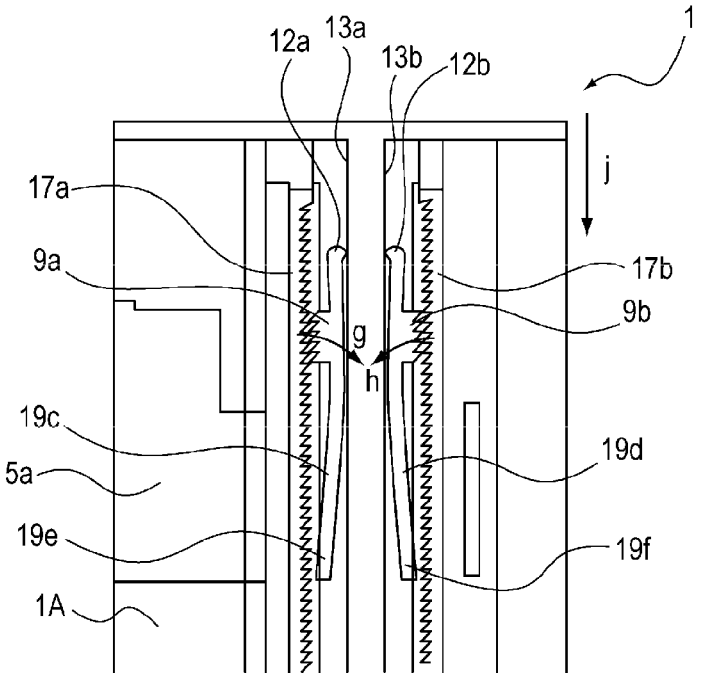
FIG. 19B is the L-L sectional view of FIG. 15 illustrating a state in which the engaging portion and the engaged portion are disengaged by operating the operation portion of the regulating member according to the third embodiment to rotate in the regulating direction of the small-size sheet.

Further, sliding portions 12*a*, 12*b* illustrated in FIGS. 18B and 19B are provided in the holding mechanism portion. When the operation member 8 is pressed, a resistance force can be provided by the sliding portions 12*a*, 12*b* so that stable states of engagement and disengagement can be maintained when the side end regulating member 5*a* moves.

<Holding Mechanism Portion>

Figure 14A:
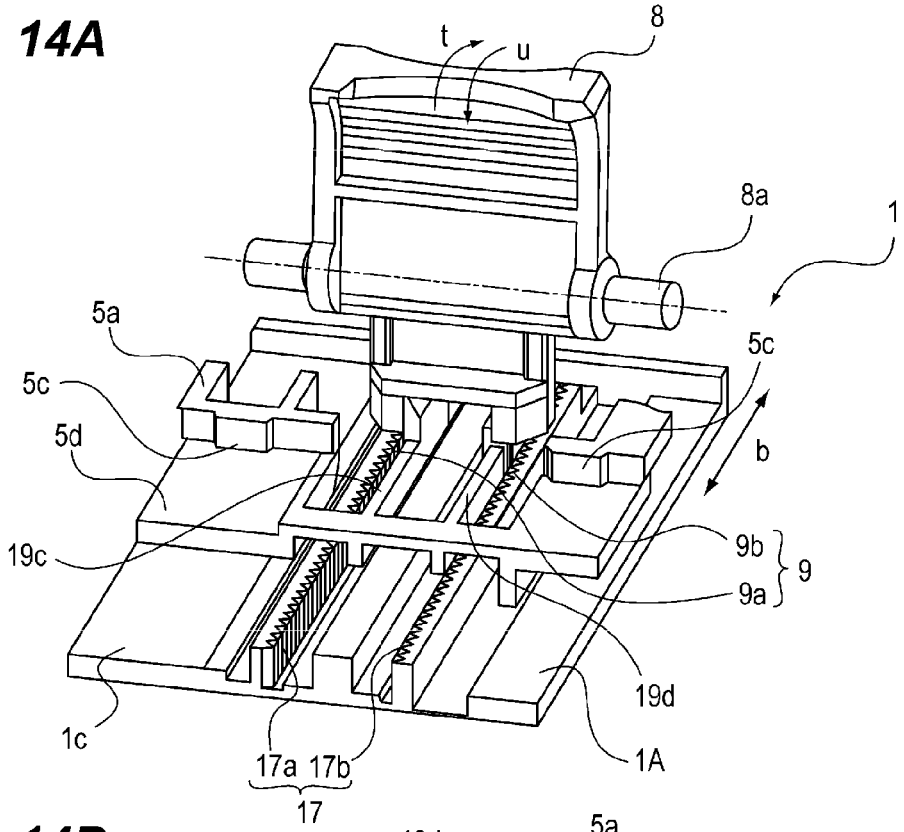
FIG. 14A is a perspective explanatory view illustrating the peripheral configuration of the regulating member according to the third embodiment.
Figure 14B:
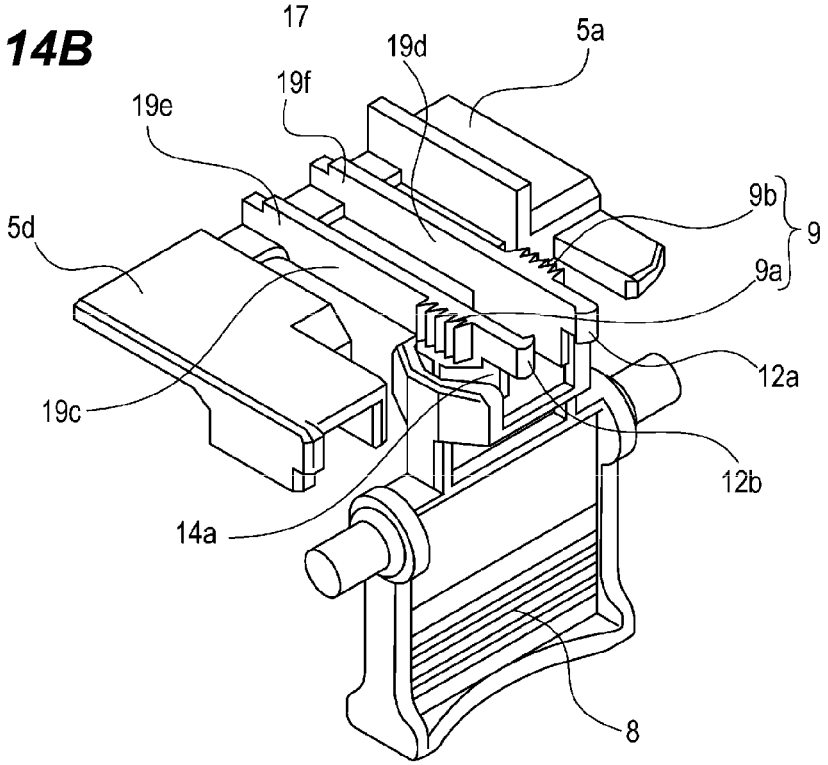
FIG. 14B is a perspective explanatory view illustrating the configuration when the regulating member according to the third embodiment is viewed from below.

The configuration of the holding mechanism portion between the side end regulating member 5*a* and the cassette body 1A will be described using FIGS. 13 to 19. FIG. 14 is a perspective view illustrating the holding mechanism portion of the side end regulating member 5*a* of the cassette body 1A. FIG. 14A is a perspective view of the side end regulating member 5*a* and the operation member 8 when viewed from above. FIG. 14B is a perspective view of the side end regulating member 5*a* and the operation member 8 when viewed from below.

Figure 15:
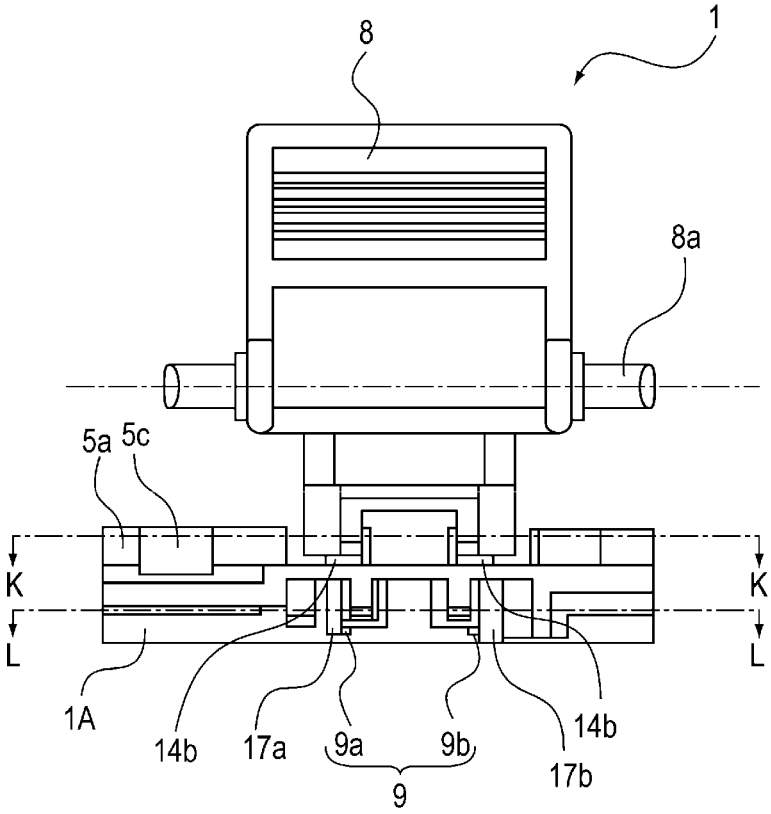
FIG. 15 is a front explanatory view illustrating the peripheral configuration of the regulating member according to the third embodiment.
Figure 17A:
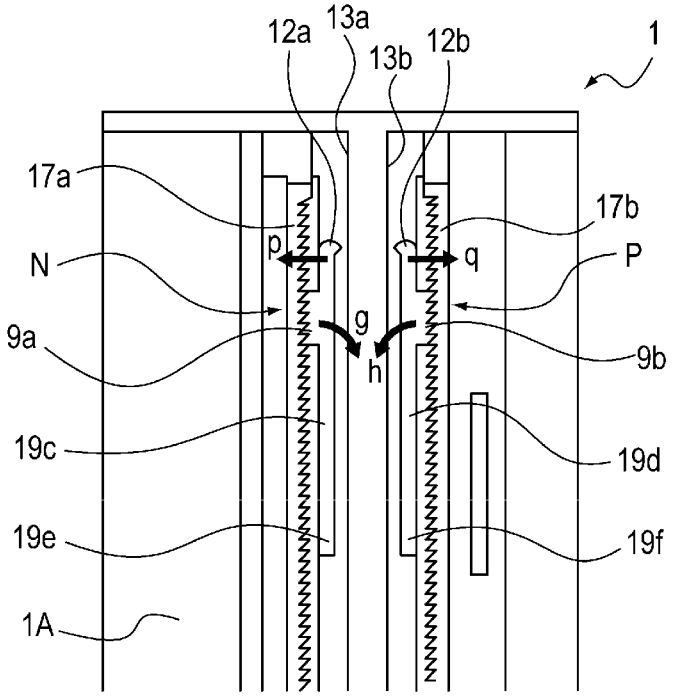
FIG. 17A is an L-L sectional view of FIG. 15 illustrating a state in which the engaging portion and the engaged portion are engaged by the operation portion of the regulating member according to the third embodiment being set to the home position.
Figure 17B:
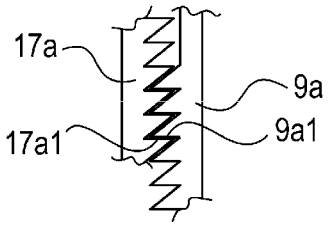
FIG. 17B is an enlarged view of an N portion and a P portion of FIG. 17A.
Figure 17C:
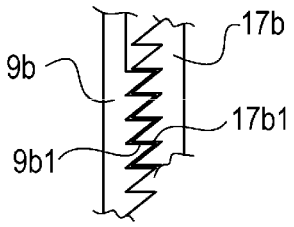
FIG. 17C is an enlarged view of the N portion and the P portion of FIG. 17A.

FIG. 15 is a front view illustrating the holding mechanism portion of the side end regulating member 5*a*. FIGS. 16 and 17 are horizontal sectional views illustrating the side end regulating member 5*a*. FIG. 16 is an H-H sectional view of FIG. 15 illustrating a pair of abutted surfaces 14*a*, 14*b* acting as switching surfaces of the side end regulating member 5*a* and the pair of abutting surfaces 15*a*, 15*b* that can abut on the abutted surfaces 14*a*, 14*b*. FIG. 17A is an L-L sectional view of FIG. 15 illustrating the engaging portions 9*a*, 9*b* made of the tooth row 9 constituting the holding mechanism portion of the side end regulating member 5*a* and the rack tooth rows 17*a*, 17*b* to be the engaged portion 17 engaged with the engaging portions 9*a*, 9*b*. FIG. 17B is an N portion enlarged view of FIG. 17A and FIG. 17C is a P portion enlarged view of FIG. 17A.

As illustrated in FIGS. 14 and 15, the two tooth rows 9 provided in the side end regulating member 5*a* are provided via elastic deformation portions 19*c*, 19*d* capable of elastic deformation. As illustrated in FIG. 14B, the tooth row 9 includes the engaging portions 9*a*, 9*b* constituted by a plurality of triangular teeth continuing on an outer surface. The engaging portions 9*a*, 9*b* are provided on the base plate 1*c* of the cassette body 1A and configured to be able to engage with the rack tooth rows 17*a*, 17*b* to be the engaged portion 17 constituted by the plurality of triangular teeth continuously arranged along the direction of movement of the side end regulating member 5*a*.

The engaging portions 9*a*, 9*b* made of the tooth row 9 provided in the side end regulating member 5*a* are geared and engaged with the rack tooth rows 17*a*, 17*b* to be the engaged portion 17 provided on the base plate 1*c* of the cassette body 1A. Accordingly, the side end regulating member 5*a* is fixed and held in the set position according to the size in the width direction of the sheet S. The engaging portions 9*a*, 9*b* made of the tooth row 9 provided in the side end regulating member 5*a* and the rack tooth rows 17*a*, 17*b* to be the engaged portion 17 provided on the base plate 1*c* of the cassette body 1A constitute the holding mechanism portion of the side end regulating member 5*a*.

By adopting triangular teeth for respective teeth of the engaging portions 9*a*, 9*b* and the rack tooth rows 17*a*, 17*b* like in the present embodiment, a mechanically high holding strength can be ensured. As a result, respective pitches of the engaging portions 9*a*, 9*b* and the rack tooth rows 17*a*, 17*b* can be made smaller so that the set position of the side end regulating member 5*a* can be fine-tuned.

In the present embodiment, as illustrated in FIGS. 17B and 17C, the shapes of teeth of the engaging portions 9*a*, 9*b* are set in the opposite directions. That is, the engaging portion 9*a* illustrated in FIG. 17B has a lower portion of FIG. 17B configured as a substantially vertical surface 9*a*1 with respect to the direction of movement of the side end regulating member 5*a* and an upper portion configured as an inclined plane. The engaging portion 9*b* illustrated in FIG. 17C is an example having an upper portion of FIG. 17C configured as a substantially vertical surface 9*b*1 with respect to the direction of movement of the side end regulating member 5*a* and a lower portion configured as an inclined plane.

The side end regulating member 5*a* is moved in both of the large size regulating direction and the small size regulating direction of the sheet S. In order to generate a large resistance force in both cases, substantially vertical surfaces 9*a*1, 9*b*1 are provided in the engaging portions 9*a*, 9*b* with respect to the direction of movement of the side end regulating member 5*a* on the large size regulating direction side and the small size regulating direction side of the sheet S respectively. Then, when the side end regulating member 5*a* receives a force in the large size regulating direction or the small size regulating direction of the sheet S, the substantially vertical surfaces 9*a*1, 9*b*1 of the engaging portions 9*a*, 9*b* and substantially vertical surfaces 17*a*1, 17*b*1 of the rack tooth rows 17*a*, 17*b* are made to be pressed.

Therefore, when the side end regulating member 5*a* receives a force in the large size regulating direction or the small size regulating direction of the sheet S, the substantially vertical surfaces 9*a*1, 9*b*1 of the engaging portions 9*a*, 9*b* and the substantially vertical surfaces 17*a*1, 17*b*1 of the rack tooth rows 17*a*, 17*b* are pressed. Accordingly, the force can be received and high holding power of the side end regulating member 5*a* can thereby be ensured. Also, the substantially vertical surfaces 9*a*1, 9*b*1 of the engaging portions 9*a*, 9*b* and the substantially vertical surfaces 17*a*1, 17*b*1 of the rack tooth rows 17*a*, 17*b* abut on and engage with each other in a direction substantially perpendicular to the direction of movement of the side end regulating member 5*a*.

Accordingly, the side end regulating member 5*a* receives a force in the large size regulating direction or the small size regulating direction of the sheet S and the engaging portions 9*a*, 9*b* of the tooth row 9 is deformed in the direction of movement of the side end regulating member 5*a*. However, the engagement direction of the substantially vertical surfaces 9*a*1, 9*b*1 of the engaging portions 9*a*, 9*b* and the substantially vertical surfaces 17*a*1, 17*b*1 of the rack tooth rows 17*a*, 17*b* and the deformation direction of the engaging portions 9*a*, 9*b* are substantially orthogonal. Therefore, high holding power of the side end regulating member 5*a* can thereby be ensured.

As illustrated in FIG. 14B, the engaging portions 9*a*, 9*b* of the tooth row 9 use root portions 19*e*, 19*f* of the elastic deformation portions 19*c*, 19*d* extending from the engaging portions 9*a*, 9*b* respectively as respective fixed ends. Then, as illustrated in FIG. 17A, the engaging portion 9*a* is configured to be deformable in an arrow g direction in FIG. 17A by elastic deformation of the elastic deformation portion 19*c*. Similarly, the engaging portion 9*b* is configured to be deformable in an arrow h direction in FIG. 17A by elastic deformation of the elastic deformation portion 19*d*.

Further, the engaging portions 9*a*, 9*b* of the tooth row 9 are disengaged from the rack tooth rows 17*a*, 17*b* of the engaged portion 17 by elastically deforming the elastic deformation portions 19*c*, 19*d* in the arrow g, h directions in FIG. 17A around the root portions 19*e*, 19*f* respectively. In this case, due to restoring forces of the elastic deformation portions 19*c*, 19*d*, forces in arrow p, q directions in FIG. 17A that engage the engaging portions 9*a*, 9*b* of the tooth row 9 with the rack tooth rows 17*a*, 17*b* of the engaged portion 17 arise respectively. Accordingly, the engaging portions 9*a*, 9*b* of the tooth row 9 are held in a geared and engaged state with the rack tooth rows 17*a*, 17*b* of the engaged portion 17. As a result, the side end regulating member 5*a* is held by being engaged with the cassette body 1A.

When the engaging portions 9*a*, 9*b* of the tooth row 9 are held in a geared and engaged state with the rack tooth rows 17*a*, 17*b* of the engaged portion 17, elastic deformation of the elastic deformation portions 19*c*, 19*d* is restored to their original states. If, for example, the elastic deformation portions 19*c*, 19*d* are formed from, for example, resin, mold creeping of the elastic deformation portions 19*c*, 19*d* (phenomenon in which when a load is applied to the elastic deformation portions 19*c*, 19*d*, deformation increases with time) can be avoided.

<Disengaging Mechanism Portion>

Next, details of the mechanism by which the side end regulating member 5*a* and the cassette body 1A are disengaged will be described using FIGS. 18 and 19. FIG. 18 is a horizontal sectional view illustrating a state in which the engaging portions 9*a*, 9*b* of the tooth row 9 and the rack tooth rows 17*a*, 17*b* of the engaged portion 17 are disengaged by operating the operation member 8 illustrated in FIG. 14 to rotate in an arrow t direction as the large size regulating direction of the sheet S. FIG. 18A is an H-H sectional view of FIG. 15 illustrating the pair of abutted surfaces 14*a*, 14*b* acting as switching surfaces and the pair of abutting surfaces 15*a*, 15*b* that can abut on the abutted surfaces 14*a*, 14*b*. FIG. 18B is an L-L sectional view of FIG. 15 illustrating the rack tooth rows 17*a*, 17*b* of the engaged portion 17 to be a holding mechanism portion and the engaging portions 9*a*, 9*b* of the tooth row 9 capable of engaging with the rack tooth rows 17*a*, 17*b*.

FIG. 19 is a horizontal sectional view illustrating a state in which the engaging portions 9*a*, 9*b* of the tooth row 9 and the rack tooth rows 17*a*, 17*b* of the engaged portion 17 are disengaged by operating the operation member 8 illustrated in FIG. 14 to rotate in an arrow u direction as the small size regulating direction of the sheet S. FIG. 19A is an H-H sectional view of FIG. 15 illustrating the pair of abutted surfaces 14*a*, 14*b* acting as switching surfaces and the pair of abutting surfaces 15*a*, 15*b* that can abut on the abutted surfaces 14*a*, 14*b*. FIG. 19B is an L-L sectional view of FIG. 15 illustrating the rack tooth rows 17*a*, 17*b* of the engaged portion 17 to be a holding mechanism portion and the engaging portions 9*a*, 9*b* of the tooth row 9 capable of engaging with the rack tooth rows 17*a*, 17*b*.

As illustrated in FIG. 14, the operation member 8 is rotatably provided in the arrow t, u directions around the spindle 8*a* to be a rotation axis arranged above the abutting portion 5*c* of the side end regulating member 5*a* in a direction substantially perpendicular to the direction of movement of the side end regulating member 5*a*. The spindle 8*a* of the operation member 8 is provided in the side end regulating member 5*a* via a bearing portion (not illustrated). Accordingly, the operation member 8 integrally moves with the side end regulating member 5*a*.

As illustrated in FIG. 14B, the pair of abutted surfaces 14*a*, 14*b* made of a mountain-shaped cross-section inclined surface provided with a V-shaped height extending to the outer side is provided in the neighborhood above the engaging portions 9*a*, 9*b* of the tooth row 9 provided in the side end regulating member 5*a*. On the lower side of the spindle 8*a* of the operation member 8, the pair of abutting surfaces 15*a*, 15*b* capable of abutting on the abutted surfaces 14*a*, 14*b* accompanying a rotating operation around the spindle 8*a* of the operation member 8 and made of a V-shaped cross-section inclined surface provided with a V-shaped recess extending to the outer side is provided.

The pair of abutting surfaces 15*a*, 15*b* is provided in the operation member 8. Accordingly, the pair of abutting surfaces 15*a*, 15*b* is integrally rotated around the spindle 8*a* with the operation member 8 and the pair of abutting surfaces 15*a*, 15*b* is loosely fitted into the pair of abutted surfaces 14*a*, 14*b* according to a rotating direction of the operation member 8 indicated by the arrow t, u directions in FIG. 14.

As illustrated in FIGS. 18A and 19A, the abutting surfaces 15*a*, 15*b* provided in the operation member 8 and the abutted surfaces 14*a*, 14*b* provided near the engaging portions 9*a*, 9*b* of the tooth row 9 respectively abut on each other selectively when appropriate. Accordingly, the abutting surfaces 15*a*, 15*b* provided in the operation member 8 abut on the abutted surfaces 14*a*, 14*b* simultaneously with a rotating operation of the operation member 8 to elastically deform the elastic deformation portions 19*c*, 19*d* in the arrow p, q directions illustrated in FIGS. 17A and 18B around the root portions 19*e*, 19*f*.

Accordingly, the engaging portions 9*a*, 9*b* of the tooth row 9 provided on the side of the side end regulating member 5*a* and the rack tooth rows 17*a*, 17*b* of the engaged portion 17 provided on the side of the base plate 1*c* of the cassette body 1A are disengaged. The operation member 8 switches engagement and disengagement of the rack tooth rows 17*a*, 17*b* of the engaged portion 17 and the engaging portions 9*a*, 9*b* of the tooth row 9.

For example, in order to accommodate the large-size sheet S inside the cassette body 1A, the operation member 8 is pressed in the arrow f direction in FIG. 18, which is the same as the direction of movement of the side end regulating member 5*a*, so that the side end regulating member 5*a* is moved in the large size regulating direction indicated by the arrow f direction in FIG. 18. Then, the operation member 8 is rotated in the arrow t direction in FIG. 14 around the spindle 8*a*.

Accompanying the rotation, the abutting surfaces 15*a*, 15*b* are loosely fitted into the abutted surfaces 14*a*, 14*b* provided with a V-shaped height provided in the respective neighborhoods of the engaging portions 9*a*, 9*b* of the tooth row 9. Then, the abutting surfaces 15*a*, 15*b* provided with a V-shaped recess provided in the operation member 8 move in the opposite direction (down direction in FIG. 18A) of the arrow f direction in FIG. 18. Then, the abutted surface 14*a* illustrated in the upper portion of FIG. 18A of the pair of abutted surfaces 14*a*, 14*b* is pressed.

Accordingly, the engaging portions 9*a*, 9*b* of the tooth row 9 illustrated in FIG. 18B move in the arrow g, h directions in FIG. 18B as the direction in which engagement with the cassette body 1A is disengaged by using the root portions 19*e*, 19*f* of the elastic deformation portions 19*c*, 19*d* as fixed ends.

Then, the engaging portion 9*a* and the rack tooth row 7*a* are disengaged and the engaging portion 9*b* and the rack tooth row 7*b* are disengaged.

In this manner, the engaging portions 9*a*, 9*b* and the rack tooth rows 17*a*, 17*b* are disengaged. Accordingly, when the side end regulating member 5*a* is moved in the large size regulating direction of the sheet S indicated by the arrow f direction in FIG. 18B to change the set position of the side end of the sheet S thereafter, the side end regulating member 5*a* can easily be moved.

That is, a pressing operation of the operation member 8 is performed in the direction in which the side end regulating member 5*a* should be moved. Accordingly, the operation member 8 rotates around the spindle 8*a* and the abutting surfaces 15*a*, 15*b* abut on and press the abutted surfaces 14*a*, 14*b*. Then, the elastic deformation portions 19*c*, 19*d* are elastically deformed and the engaging portions 9*a*, 9*b* of the tooth row 9 are detached and disengaged from the rack tooth rows 17*a*, 17*b* of the engaged portion 17 so that the side end regulating member 5*a* becomes movable.

If, after the movement of the side end regulating member 5*a* is completed, pressing of the operation member 8 is released, the engaging portions 9*a*, 9*b* and the rack tooth rows 17*a*, 17*b* return an original state of engagement due to restoring forces of the elastic deformation portions 19*c*, 19*d*. Accordingly, the side end regulating member 5*a* can be fixed and held in the intended set position.

Similarly, the elastic deformation portions 19*c*, 19*d* are restored. As illustrated in FIG. 16, the pair of abutting surfaces 15*a*, 15*b* provided with a V-shaped recess provided in the operation member 8 is fitted into the pair of abutted surfaces 14*a*, 14*b* provided with a V-shaped height provided in the respective neighborhoods of the engaging portions 9*a*, 9*b* of the tooth row 9. Accordingly, the operation member 8 is also set to the home position.

That is, when the pressing operation of the operation member 8 is released, the abutting surfaces 15*a*, 15*b* move away from the abutted surfaces 14*a*, 14*b* to restore the elastic deformation portions 19*c*, 19*d* and the engaging portions 9*a*, 9*b* of the tooth row 9 are engaged with the rack tooth rows 17*a*, 17*b* of the engaged portion 17 to fix the side end regulating member 5*a*.

Also, in order to accommodate the small-size sheet S inside the cassette body 1A, the operation member 8 is pressed in the arrow j direction in FIG. 19, which is the same as the direction of movement of the side end regulating member 5*a*, so that the side end regulating member 5*a* is moved in the small size regulating direction of the sheet S indicated by the arrow j direction in FIG. 19. Then, the operation member 8 is rotated in the arrow u direction in FIG. 14A around the spindle 8*a*.

Accompanying the rotation, as illustrated in FIG. 19A, there is provided the abutted surface 14*b* illustrated in the lower portion of FIG. 19A of the pair of abutted surfaces 14*a*, 14*b* provided with a V-shaped height. There is also provided the abutting surface 15*b* loosely fitted into the abutted surface 14*b* and illustrated in the lower portion of FIG. 19A of the pair of abutting surfaces 15*a*, 15*b* provided with a V-shaped recess. The abutting surface 15*b* moves in the opposite direction (up direction in FIG. 19A) of the arrow j direction in FIG. 19A and the abutting surface 15*b* presses the abutted surface 14*b*.

Accordingly, as illustrated in FIG. 19B, the engaging portions 9*a*, 9*b* of the tooth row 9 provided in the side end regulating member 5*a* move by using the root portions 19*e*, 19*f* of the elastic deformation portions 19*c*, 19*d* as fixed ends. Then, the engaging portions 9*a*, 9*b* move in the arrow g, h directions in FIG. 19B as the directions in which engagement with the rack tooth rows 17*a*, 17*b* of the engaged portion 17 provided on the base plate 1*c* of the cassette body 1A is disengaged. Then, the engaging portion 9*a* and the rack tooth row 7*a* are disengaged and the engaging portion 9*b* and the rack tooth row 7*b* are disengaged.

In this manner, the engaging portions 9*a*, 9*b* and the rack tooth rows 17*a*, 17*b* are disengaged. Accordingly, the side end regulating member 5*a* is thereafter moved in the small size regulating direction indicated by the arrow j direction in FIG. 19B to change the set position of the side end of the sheet S. In this case, the side end regulating member 5*a* can easily be moved.

After the movement of the side end regulating member 5*a* is completed, pressing of the operation member 8 is released. Then, the engaging portions 9*a*, 9*b* and the rack tooth rows 17*a*, 17*b* return an original state of engagement due to restoring forces of the elastic deformation portions 19*c*, 19*d*. Accordingly, the side end regulating member 5*a* can be fixed and held in the set position on the side end of the intended sheet S. Similarly, also the operation member 8 returns to its home position due to restoring forces of the elastic deformation portions 19*c*, 19*d*.

According to the present embodiment, regardless of the direction of the arrow t, u directions illustrated in FIG. 14A in which a pressing operation of the operation member 8 is performed, as illustrated in FIGS. 18B and 19B, the engaging portion 9*a* of the tooth row 9 moves in the same direction of the arrow g direction in FIGS. 18B and 19B. Also, the engaging portion 9*b* of the tooth row 9 moves in the same direction of the arrow h direction in FIGS. 18B and 19B. Accordingly, the engaging portions 9*a*, 9*b* and the rack tooth rows 17*a*, 17*b* are disengaged and therefore, the side end regulating member 5*a* becomes movable.

The side end regulating member 5*a* is moved in one direction or in the opposite direction. At this point, a pressing operation of the operation member 8 is performed in the direction to be moved. Accordingly, holding of the side end regulating member 5*a* by the holding mechanism portion comprising engaging portions 9*a*, 9*b* and the rack tooth rows 17*a*, 17*b* is released. Then, the side end regulating member 5*a* becomes movable.

<Sliding Mechanism Portion>

Next, the configuration of a sliding mechanism portion between the side end regulating member 5*a* and the cassette body 1A will be described using FIGS. 18 and 19. As illustrated in FIGS. 18 and 19, the sliding portions 12*a*, 12*b* are provided by extending the engaging portions 9*a*, 9*b* made of the tooth row 9 provided in the side end regulating member 5*a*. On the base plate 1*c* of the cassette body 1A, on the other hand, slid portions 13*a*, 13*b* arranged along the direction of movement of the side end regulating member 5*a* are provided. The sliding portions 12*a*, 12*b* are provided on the rear side of the engaging portions 9*a*, 9*b* made of the tooth row 9 and slide along the slid portions 13*a*, 13*b* with the movement of the side end regulating member 5*a*.

A pressing operation of the operation member 8 is performed in the direction in which the side end regulating member 5*a* should be moved. Then, the abutting surfaces 15*a*, 15*b* rotating integrally with the operation member 8 around the spindle 8*a* abut on and engage with the abutted surfaces 14*a*, 14*b* provided near the engaging portions 9*a*, 9*b* made of the tooth row 9. Then, the elastic deformation portions 19*c*, 19*d* provided integrally with the abutted surfaces 14*a*, 14*b* are elastically deformed in the arrow g, h directions in FIGS. 18B and 19B around the root portions 19*e*, 19*f*.

Then, the sliding portions 12*a*, 12*b* abut on the slid portions 13*a*, 13*b*. Thereafter, the engaging portions 9*a*, 9*b* of the tooth row 9 are detached and disengaged from the rack tooth rows 17*a*, 17*b* of the engaged portion 17 so that the side end regulating member 5*a* becomes movable.

Therefore, the engaging portions 9*a*, 9*b* of the tooth row 9 are detached and disengaged from the rack tooth rows 17*a*, 17*b* of the engaged portion 17. Then, when the side end regulating member 5*a* becomes movable, the sliding portions 12*a*, 12*b* abut on the slid portions 13*a*, 13*b* to add a resistance force to the movement of the side end regulating member 5*a*. As a result, when a pressing operation of the operation member 8 is performed, the engaging portions 9*a*, 9*b* of the tooth row 9 and the rack tooth rows 17*a*, 17*b* of the engaged portion 17 are completely disengaged. In addition to the force that elastically deforms the elastic deformation portions 19*c*, 19*d* until then, the sliding portions 12*a*, 12*b* and the slid portions 13*a*, 13*b* abut on each other. Accordingly, a force to limit elastic deformation of the elastic deformation portions 19*c*, 19*d* acts to increase the force needed to perform a pressing operation of the operation member 8.

Accordingly, the side end regulating member 5*a* can be moved while a state in which the engaging portions 9*a*, 9*b* of the tooth row 9 and the rack tooth rows 17*a*, 17*b* of the engaged portion 17 are completely disengaged by performing a pressing operation of the operation member 8 being maintained in a stable manner. Therefore, abnormal sound generated when a disengaged state of the engaging portions 9*a*, 9*b* of the tooth row 9 and the rack tooth rows 17*a*, 17*b* of the engaged portion 17 is unstable can be avoided.

In addition, there is no possibility of friction between the engaging portions 9*a*, 9*b* of the tooth row 9 and the rack tooth rows 17*a*, 17*b* of the engaged portion 17. Because a frictional resistance force generated by abutting of the sliding portions 12*a*, 12*b* and the slid portions 13*a*, 13*b* is generated only when the operation member 8 is pressed, mold creeping of the elastic deformation portions 19*c*, 19*d* can be avoided.

The inclination angles of the pair of abutting surfaces 15*a*, 15*b* provided in the operation member 8 and the inclination angle of the pair of abutted surfaces 14*a*, 14*b* provided near the engaging portions 9*a*, 9*b* of the tooth row 9 are as described below. That is, the inclination angles can be set differently on the side of the elastic deformation portions 19*c*, 19*d* (elastic portion side) and on the side of the sliding portions 12*a*, 12*b*, which is the opposite side of the elastic deformation portions 19*c*, 19*d*.

Further, the inclination angles of the pair of abutting surfaces 15*a*, 15*b* provided in the operation member 8 can be set differently on the side of the elastic deformation portions 19*c*, 19*d* (elastic portion side) and on the side of the sliding portions 12*a*, 12*b*, which is the opposite side of the elastic deformation portions 19*c*, 19*d*.

These inclination angles are set appropriately. Accordingly, regardless of the operation direction in which a pressing operation of the operation member 8 is performed in the direction in which the side end regulating member 5*a* should be moved, the timing in which the engaging portions 9*a*, 9*b* of the tooth row 9 and the rack tooth rows 17*a*, 17*b* of the engaged portion 17 are completely disengaged can be aligned. Operability is thereby improved.

As described above, a holding mechanism portion configured integrally with the side end regulating member 5*a* is included. Then, the tooth row 9, the abutted surfaces 14*a*, 14*b* acting as switching surfaces near the tooth row 9, and the elastic deformation portions 19*c*, 19*d* extending from the tooth row 9 are provided in the holding mechanism portion. Accordingly, operations in both directions of the large size regulating direction and the small size regulating direction of the sheet S and holding of the side end regulating member 5*a* can be enabled by an extremely small number of components.

Accordingly, assembling properties are improved while operability of the side end regulating member 5*a* being maintained. In addition, misregistration of the side end regulating member 5*a* caused by rattling of components is eliminated while the side end regulating member 5*a* is fixed, improving print precision.

By providing the sliding portions 12*a*, 12*b* formed integrally with the tooth row 9, the side end regulating member 5*a* can be moved while a state in which the tooth row 9 and the engaged portion 17 are completely disengaged being maintained in a stable manner. Accordingly, abnormal sound generated when a disengaged state of the tooth row 9 and the engaged portion 17 is unstable can be avoided.

There is no possibility of friction between the engaging portions 9*a*, 9*b* of the tooth row 9 and the rack tooth rows 17*a*, 17*b* of the engaged portion 17. Further, after the movement of the side end regulating member 5*a* is completed, pressing of the operation member 8 is released. Then, the operation member 8 returns to its home position due to restoring forces of the elastic deformation portions 19*c*, 19*d* that are elastically deformed and deformation of the elastic deformation portions 19*c*, 19*d* returns to their original states. Accordingly, mold creeping of the elastic deformation portions 19*c*, 19*d* can be avoided, stabilizing quality.

In the present embodiment, an example in which the present invention is applied to the side end regulating member 5*a* is described, but a similar configuration can be applied to the other side end regulating member 5*b* or the rear end regulating member 3.

Fourth Embodiment

The fourth embodiment of the present invention will be described. In the description of the fourth embodiment below, the description of content (configurations and operations) common to the first embodiment to the third embodiment is omitted when appropriate.

Next, a sheet accommodation apparatus according to the present embodiment, a sheet feeding apparatus including the sheet accommodation apparatus, and the configuration of the fourth embodiment of the image forming apparatus will be described using FIGS. 20 to 22. The same reference numerals or the same member names, even if reference numerals are different, are attached to components configured in the same manner as in the third embodiment and the description thereof is omitted.

<Holding Mechanism Portion>

Figure 20:
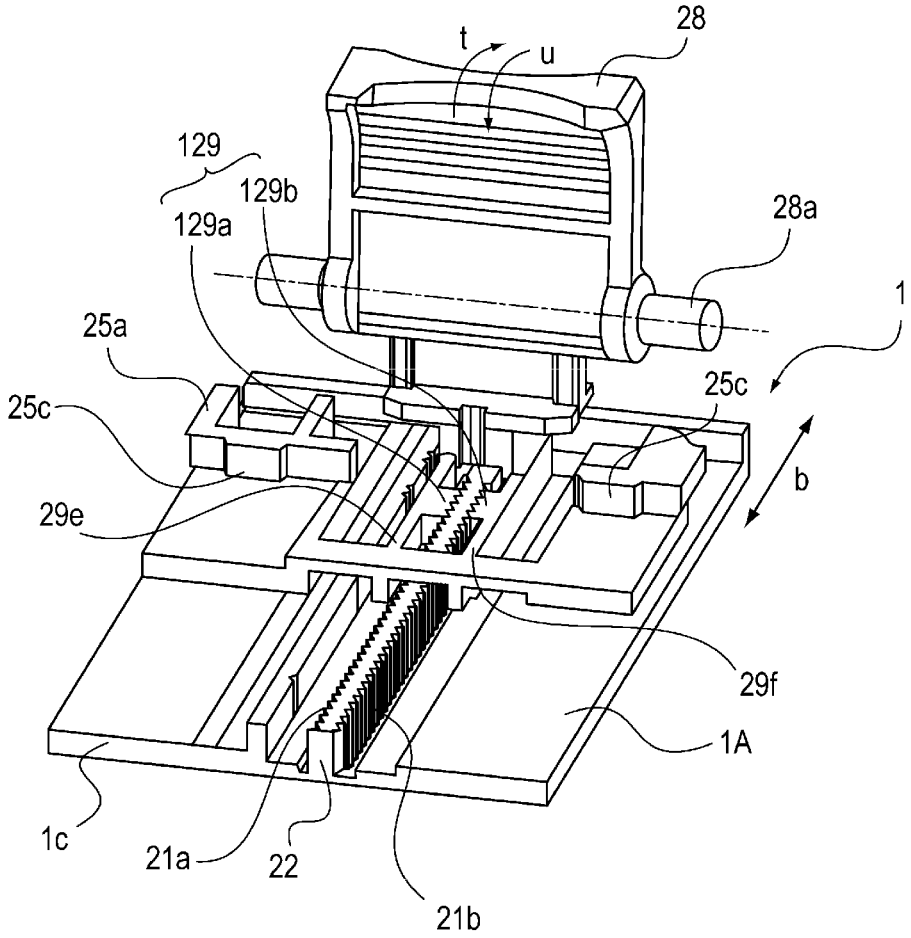
FIG. 20 is a perspective explanatory view illustrating the peripheral configuration of the regulating member according to a fourth embodiment.
Figure 21:
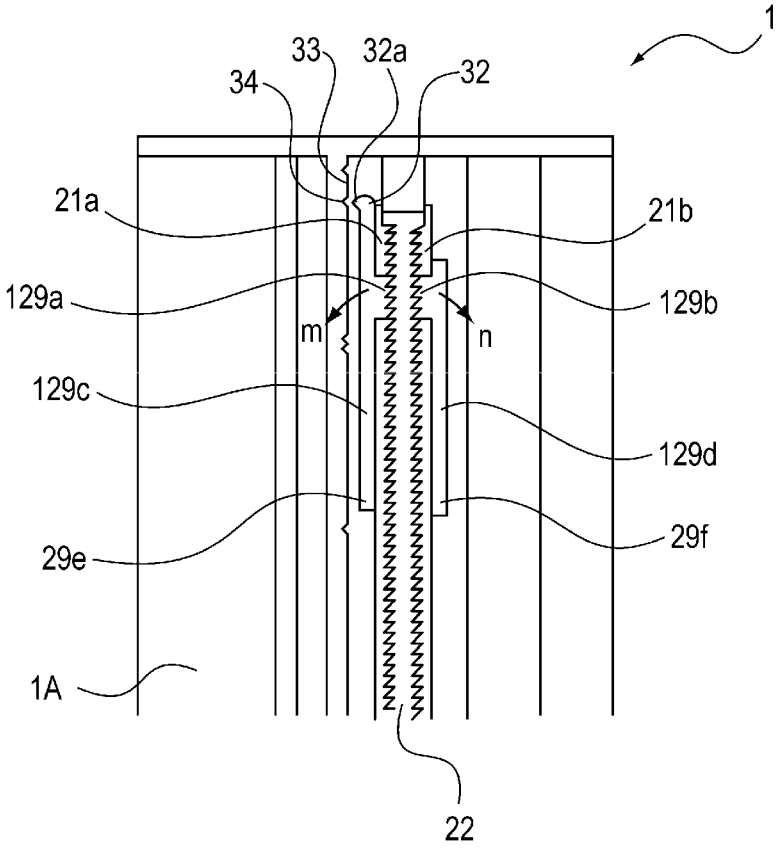
FIG. 21 is a sectional view corresponding to an L-L section of FIG. 15 illustrating a state in which the engaging portion and the engaged portion are engaged by the operation portion of the regulating member according to the fourth embodiment being set to the home position.

First, the configuration of the holding mechanism portion between the cassette body 1A to be a sheet accommodation portion that accommodates the sheet S and a side end regulating member 25*a* using FIGS. 20 and 21. The side end regulating member 25*a* is provided movably with respect to the cassette body 1A and configured as a regulating member that regulates the end position of the sheet S accommodated inside the cassette body 1A (inside the sheet accommodation portion). An abutting portion 25*c* abuts on a side end of the sheet S.

FIG. 20 is a perspective view illustrating a holding mechanism portion of the side end regulating member 25*a* of the cassette body 1A. FIG. 21 is a horizontal sectional view corresponding to an L-L section of FIG. 15 illustrating the holding mechanism portion of the side end regulating member 25*a* of the cassette body 1A. As illustrated in FIG. 20, engaging portions 129*a*, 129*b* made of a tooth row 129 provided in the side end regulating member 25*a* are provided via elastic portions 129*c*, 129*d* that can elastically be deformed with respect to the side end regulating member 25*a*. Then, engaged portions 21*a*, 21*b* made of a rack tooth row 21 are provided on the base plate 1*c* of the cassette body 1A. The engaged portions 21*a*, 21*b* made of the rack tooth row 21 arranged along the direction of movement of the side end regulating member 25*a* and the engaging portions 129*a*, 129*b* made of the tooth row 129 are configured to be able to gear and engage with each other.

The engaging portions 129*a*, 129*b* of the tooth row 129 extended by the elastic portions 129*c*, 129*d* are configured by including a plurality of continuous triangular teeth on the inner side of the side face. The engaging portions 129*a*, 129*b* of the tooth row 129 are engaged with the engaged portions 21*a*, 21*b* made of the rack tooth row 21 including a plurality of continuous triangular teeth provided on the base plate 1*c* of the cassette body 1A.

Then, the engaging portions 129*a*, 129*b* provided in the tooth row 129 of the side end regulating member 25*a* are engaged with the engaged portions 21*a*, 21*b* provided on the base plate 1*c* of the cassette body 1A. Accordingly, the side end regulating member 25*a* is fixed and held in the set position of the side end according to the size in the width direction of the sheet S. The holding mechanism portion is constituted by engagement of the engaging portions 129*a*, 129*b* of the tooth row 129 provided in the side end regulating member 25*a* and the engaged portions 21*a*, 21*b* made of the rack tooth row 21 provided in the cassette body 1A.

In the present embodiment, as illustrated in FIG. 21, the engaging portions 129*a*, 129*b* of the tooth row 129 have, like the engaging portions 9*a*, 9*b* of the tooth row 9 described by illustrating in FIGS. 17B and 17C, the shapes of respective teeth set in the opposite directions. Accordingly, the side end regulating member 25*a* is moved in both of the large size regulating direction and the small size regulating direction of the sheet S. In this case, a substantially virtual surface with respect to the direction of movement of the side end regulating member 25*a* is provided on each of the large size regulating direction side and the small size regulating direction side to generate a large resistance force.

When the side end regulating member 25*a* receives a force in the large size regulating direction or the small size regulating direction of the sheet S, respective substantially vertical surfaces of the engaging portions 129*a*, 129*b* and the engaged portions 21*a*, 21*b* are made to be pressed.

Figure 22A:
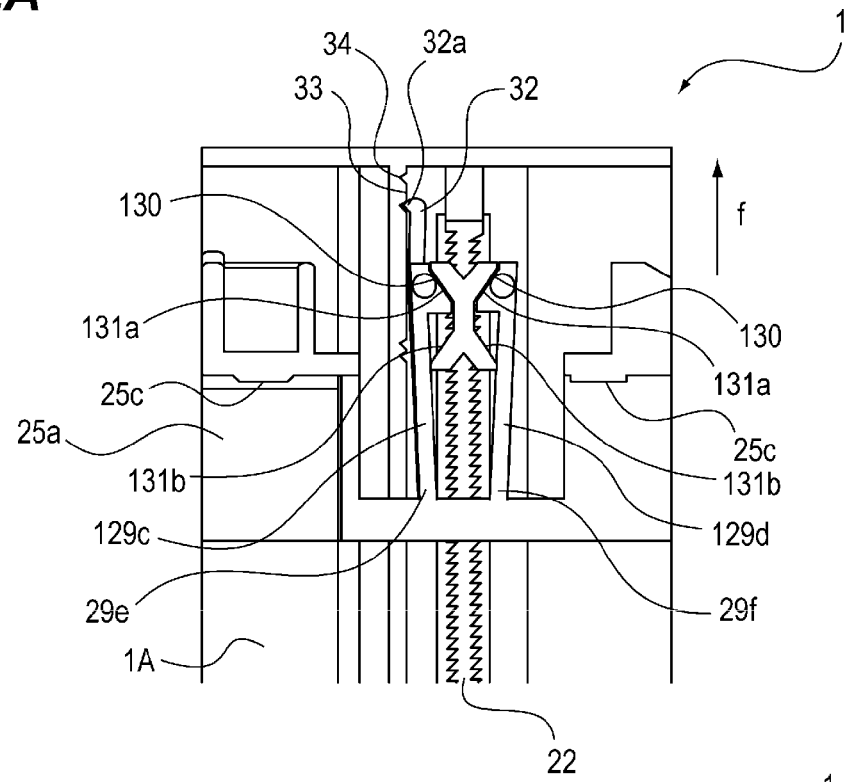
FIG. 22A is a sectional view corresponding to a K-K section of FIG. 15 illustrating a state in which the engaging portion and the engaged portion are disengaged by operating the operation portion of the regulating member according to the fourth embodiment to rotate in the regulating direction of the large-size sheet.
Figure 22B:
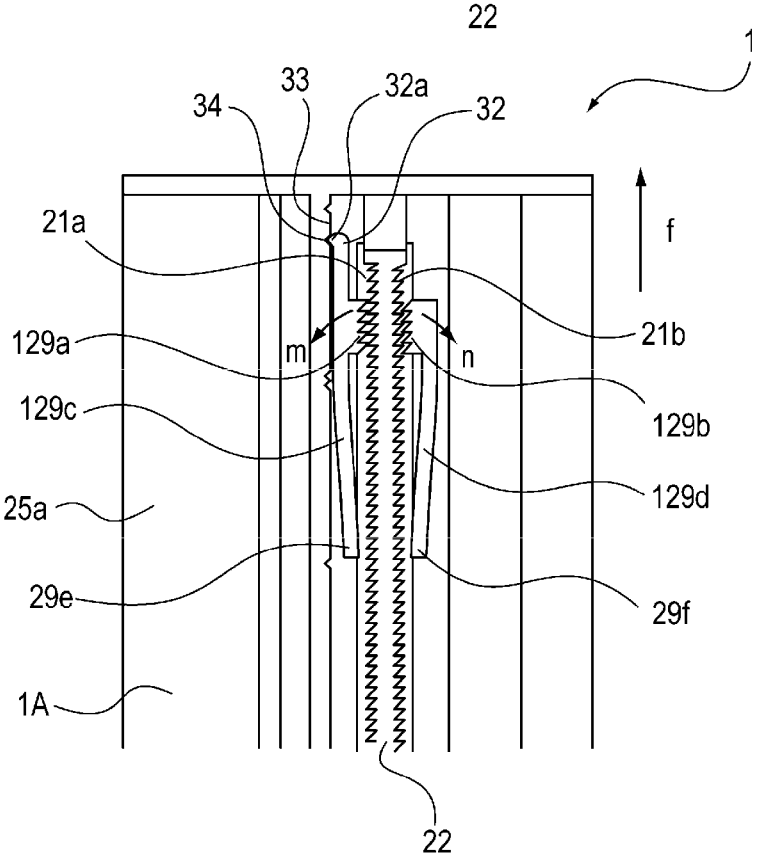
FIG. 22B is a sectional view corresponding to the L-L section of FIG. 15 illustrating a state in which the engaging portion and the engaged portion are disengaged by operating the operation portion of the regulating member according to the fourth embodiment to rotate in the regulating direction of the large-size sheet.

The engaging portions 129*a*, 129*b* of the tooth row 129 are configured to be elastically deformable in arrow m, n directions in FIG. 22B using root portions 29*e*, 29*f* of the elastic portions 129*c*, 129*d* extending from the engaging portions 129*a*, 129*b* as respective fixed ends. Further, the engaging portions 129*a*, 129*b* of the tooth row 129 and the engaged portions 21*a*, 21*b* of the rack tooth row 21 are disengaged.

In such a case, a force is generated in a direction that engages the engaging portions 129*a*, 129*b* of the tooth row 129 with the engaged portions 21*a*, 21*b* of the rack tooth row 21 due to restoring forces of the elastic portions 129*c*, 129*d* that are elastically deformed. Accordingly, the side end regulating member 25*a* is fixed and held in a state in which the engaging portions 129*a*, 129*b* of the tooth row 129 is engaged with the engaged portions 21*a*, 21*b* of the rack tooth row 21. As a result, the side end regulating member 25*a* is engaged with the cassette body 1A and held.

<Disengaging Mechanism Portion>

The configuration in which engagement of the side end regulating member 25*a* with the cassette body 1A is disengaged will be described using FIGS. 20 and 22. FIGS. 20 and 22 illustrate the operation portion 28 provided in the side end regulating member 25*a* rotatably around the spindle 28*a* made of a rotation axis arranged in a direction substantially perpendicular to the direction of movement of the side end regulating member 25*a*. The operation portion 28 switches engagement and disengagement of the engaged portions 21*a*, 21*b* of the rack tooth row 21 and the engaging portions 129*a*, 129*b* of the tooth row 129. The operation portion 28 is operated to rotate in the large size regulating direction of the sheet S indicated by the arrow t direction in FIG. 20.

FIG. 22 is a horizontal sectional view illustrating a state in which the engaging portions 129*a*, 129*b* of the tooth row 129 and the engaged portions 21*a*, 21*b* of the rack tooth row 21 are disengaged. FIG. 22A is a sectional view corresponding to an H-H section in FIG. 15. A state in which an abutted surface 130 made of an outer circumferential surface of an axial member in a circular cross-section shape provided near the engaging portions 129*a*, 129*b* of the tooth row 129 and a pair of abutting surfaces 131*a*, 131*b* abut on and engage with each other is illustrated. The pair of abutting surfaces 131*a*, 131*b* is provided in the operation portion 28 and is made of an inclined surface in a V cross-section shape capable of abutting on the abutted surface 130 accompanying a rotating operation of the operation portion 28. FIG. 22B is a sectional view corresponding to the L-L section in FIG. 15. The configuration of the holding mechanism portion configured by the engaging portions 129*a*, 129*b* of the tooth row 129 and the engaged portions 21*a*, 21*b* of the rack tooth row 21 is illustrated.

The abutting surfaces 131*a*, 131*b* illustrated in FIG. 22A are provided in the lower portion of the operation portion 28 illustrated in FIG. 20. The abutting surfaces 131*a*, 131*b* are configured by a V-shaped recess loosely fitted to the abutted surface 130 acting as a switching surface made of an outer circumferential surface of an axial member provided near the engaging portions 129*a*, 129*b* of the tooth row 129 provided in the side end regulating member 25*a* being provided.

In the present embodiment, the abutting surfaces 131*a*, 131*b* provided in the operation portion 28 abut on and engage with the abutted surface 130 provided near the engaging portions 129*a*, 129*b* of the tooth row 129. Then, a pressing operation of the operation portion 28 is performed in the direction in which the side end regulating member 25*a* should be moved. Accordingly, the operation portion 28 rotates around the spindle 28*a* and the pair of abutting surfaces 131*a*, 131*b* abuts on and presses the abutted surface 130. Then, the elastic portions 129*c*, 129*d* are elastically deformed in the arrow m, n directions in FIG. 22B and the engaging portions 129*a*, 129*b* of the tooth row 129 are detached and disengaged from the engaged portions 21*a*, 21*b* of the rack tooth row 21 so that the side end regulating member 25*a* becomes movable.

The pressing operation of the operation portion 28 is released. Then, the abutting surfaces 131*a*, 131*b* are detached from the abutted surface 130 and the elastic portions 129*c*, 129*d* that are elastically deformed are restored. Then, the engaging portions 129*a*, 129*b* of the tooth row 129 are engaged with the engaged portions 21*a*, 21*b* of the rack tooth row 21 due to restoring forces of the elastic portions 129*c*, 129*d* to fix the side end regulating member 25*a*.

For example, the large-size sheet S is accommodated in the cassette body 1A of the sheet cassette 1 to be a sheet accommodation apparatus. Thus, the side end regulating member 25*a* is moved in the large size regulating direction of the sheet S indicated by the arrow f direction in FIGS. 22A and 22B. The operation portion 28 is pressed in the arrow t direction in FIG. 20, which is the same direction as the direction of movement of the side end regulating member 25*a*. Then, the operation portion 28 rotates in the arrow t direction in FIG. 20 around the spindle 28*a*.

The abutted surface 130 made of an outer circumferential surface of an axial member is provided near the engaging portions 129*a*, 129*b* of the tooth row 129. Then, the abutting surfaces 131*a*, 131*b* provided with the V-shaped recess provided in the operation portion 28 loosely fitted to the abutted surface 130 move in the opposite direction (down direction in FIG. 22A) of the arrow f direction in FIG. 22A. Then, the abutting surface 131*a* in the up direction in FIG. 22A acting as a switching surface presses the abutted surface 130 made of an outer circumferential surface of an axial member.

Accordingly, the engaging portions 129*a*, 129*b* of the tooth row 129 illustrated in FIG. 22B are moved in the arrow m, n directions in FIG. 22B by the elastic portions 129*c*, 129*d* being elastically deformed using the root portions 29*e*, 29*f* of the elastic portions 129*c*, 129*d* as fixed ends. Accordingly, the engaging portions 129*a*, 129*b* of the tooth row 129 and the engaged portions 21*a*, 21*b* of the rack tooth row 21 are disengaged.

Accordingly, when the side end regulating member 25*a* is moved in the large size regulating direction of the sheet S to change the set position of the side end of the sheet S inside the cassette body 1A, the side end regulating member 25*a* can be changed easily.

If, after the movement of the side end regulating member 25*a* is completed, pressing of the operation portion 28 illustrated in FIG. 20 is released, the elastic portions 129*c*, 129*d* that are elastically deformed are restored. Due to restoring forces thereof, the engaging portions 129*a*, 129*b* of the tooth row 129 and the engaged portions 21*a*, 21*b* of the rack tooth row 21 return to an original state of engagement. Accordingly, the side end regulating member 25*a* can be fixed and held in the set position of the side end of the sheet S. Similarly, also the operation portion 28 returns to its home position due to restoring forces of the elastic portions 129*c*, 129*d*.

The operation when the small-size sheet S is accommodated in the cassette body 1A is to press the operation portion 28 in FIG. 20 in the arrow u direction in FIG. 20, which is the same direction as the direction of movement of the side end regulating member 25*a*. Then, the operation portion 28 rotates in the arrow u direction in FIG. 20 around the spindle 28*a*.

Accompanying the rotation, the abutting surfaces 131*a*, 131*b* provided with the V-shaped recess provided in the operation portion 28 loosely fitted to the abutted surface 130 made of an outer circumferential surface of an axial member provided near the engaging portions 129*a*, 129*b* of the tooth row 129 move in the up direction of FIG. 22A. Then, the abutting surface 131*b* in the down direction of FIG. 22A acting as a switching surface presses the abutted surface 130 made of an outer circumferential surface of an axial member.

Accordingly, the engaging portions 129*a*, 129*b* of the tooth row 129 illustrated in FIG. 22B are moved in the arrow m, n directions in FIG. 22B by the elastic portions 129*c*, 129*d* being elastically deformed using the root portions 29*e*, 29*f* of the elastic portions 129*c*, 129*d* as fixed ends. Accordingly, the engaging portions 129*a*, 129*b* of the tooth row 129 and the engaged portions 21*a*, 21*b* of the rack tooth row 21 are disengaged.

Accordingly, when the side end regulating member 25*a* is moved in the small size regulating direction of the sheet S to change the set position of the side end of the sheet S inside the cassette body 1A, the side end regulating member 25*a* can be changed easily.

<Sliding Mechanism Portion>

Next, the sliding mechanism portion between the side end regulating member 25*a* and the cassette body 1A will be described using FIGS. 21 and 22. As illustrated in FIGS. 21 and 22, a sliding portion 32 is provided by extending the one engaging portion 129*a* of the tooth row 129 constituting the holding mechanism portion. The sliding portion 32 is provided on the rear side of the one engaging portion 129*a* of the tooth row 129. On the base plate 1*c* of the cassette body 1A to be a sheet accommodation portion, on the other hand, a slid portion 33 arranged along the direction of movement of the side end regulating member 25*a* is provided. The sliding portion 32 slides along the slid portion 33 with the movement of the side end regulating member 25*a*.

When a pressing operation of the operation portion 28 illustrated in FIG. 20 is performed, the abutting surfaces 131*a*, 131*b* illustrated in FIG. 22A press the abutted surface 130 and, as illustrated in FIG. 22B, elastically deform the elastic portions 129*c*, 129*d*. Then, the sliding portion 32 provided on the rear side of the one engaging portion 129*a* abuts on the slid portion 33 and after the abutting, the engaging portions 129*a*, 129*b* of the tooth row 129 and the engaged portions 21*a*, 21*b* of the rack tooth row 21 are disengaged.

Therefore, when the engaging portions 129*a*, 129*b* of the tooth row 129 and the engaged portions 21*a*, 21*b* of the rack tooth row 21 are disengaged and the side end regulating member 25*a* becomes movable, a frictional resistance force is added by abutting of the sliding portion 32 and the slid portion 33. As a result, when a pressing operation of the operation portion 28 is performed, the engaging portions 129*a*, 129*b* of the tooth row 129 and the engaged portions 21*a*, 21*b* of the rack tooth row 21 are completely disengaged. In addition to the force that elastically deforms the elastic portions 129*c*, 129*d* until then, the sliding portion 32 and the slid portion 33 abut on each other. Accordingly, a force to limit elastic deformation of the elastic portions 129*c*, 129*d* acts to increase the force needed to perform a pressing operation of the operation portion 28.

<Standardized Size Click Portion>

Next, the configuration of a standardized size click portion in which the side end regulating member 25*a* stops in the side end position of the standardized size sheet S to provide a tactile sense will be described using FIGS. 21 and 22. As illustrated in FIGS. 21 and 22, the slid portion 33 is provided with a click groove 34 to be a groove portion that positions the side end position of the standardized size sheet S in a direction perpendicular to the direction of movement of the side end regulating member 25*a*. On the other hand, the sliding portion 32 is provided with a protruded portion 32*a* capable of fitting into the click groove 34 by protruding in a direction perpendicular to the direction of movement of the side end regulating member 25*a*.

Then, the side end regulating member 25*a* is moved to a position that regulates the side end position of the standardized size sheet S. At this point, the protruded portion 32*a* of the sliding portion 32 is elastically stopped at the click groove 34 provided in the position corresponding to the side end position of the standardized size sheet S accommodated inside the cassette body 1A by using elastic deformation of the elastic portion 129*c*. Accordingly, when the side end regulating member 25*a* reaches the side end position of the standardized size sheet S, a tactile sense is generated by the protruded portion 32*a* of the sliding portion 32 being elastically fitted into the click groove 34.

Thus, the protruded portion 32*a* of the sliding portion 32 to be a click portion and the click groove 34 of the slid portion 33 are provided near the operation portion 28. Accordingly, a tactile sense is generated when the side end regulating member 25*a* is set to the side end position of the standardized size sheet S and transmission of the tactile sense to the operation portion 28 is facilitated. Accordingly, operability when the user operates the side end regulating member 25*a* can be improved.

Further, after the movement of the side end regulating member 25*a* is completed, pressing of the operation portion 28 is released. Then, due to restoring forces of the elastic portions 129*c*, 129*d* that are elastically deformed, deformation of the elastic portions 129*c*, 129*d* is also restored to their original states. Then, deformation around the sliding portion 32 to be a click portion formed integrally with the elastic portions 129*c*, 129*d* is restored to its original state. Accordingly, mold creeping of the elastic portions 129*c*, 129*d* and around the sliding portion 32 to be a click portion can be avoided, stabilizing quality.

As described above, the holding mechanism portion configured integrally with the side end regulating member 25*a* is included. Then, the tooth row 129, the abutted surface 130 acting as a switching surface near the tooth row 129 and made of an outer circumferential surface of an axial member, and the elastic portions 129*c*, 129*d* extending from the engaging portions 129*a*, 129*b* of the tooth row 129 are provided in the holding mechanism portion. Accordingly, operations of moving in both directions of the large size regulating direction and the small size regulating direction of the sheet S and holding of the side end regulating member 25*a* can be enabled by an extremely small number of components.

Accordingly, like in the third embodiment, assembling properties are improved while operability of the side end regulating member 25*a* being maintained. In addition, misregistration of the side end regulating member 25*a* caused by rattling of components is eliminated while the side end regulating member 25*a* is fixed, improving print precision.

Also, the engaging portions 129*a*, 129*b* of the tooth row 129 provided on the side of the side end regulating member 25*a* are provided by mutually oriented to the inner side and the engaged portions 21*a*, 21*b* of the rack tooth row 21 provided on the side of the cassette body 1A are provided on both sides of one rib 22. Accordingly, the space needed for the holding mechanism portion is reduced and the size thereof can be decreased.

Also, the sliding portion 32 formed integrally with the one engaging portion 129*a* of the tooth row 129 is provided and also the protruded portion 32*a* to be a click portion in the sliding portion 32 and the click groove 34 of the slid portion 33 are provided. Accordingly, the side end regulating member 25*a* can be moved while a state in which the engaging portions 129*a*, 129*b* of the tooth row 129 and the engaged portions 21*a*, 21*b* of the rack tooth row 21 are completely disengaged being maintained in a stable manner.

Accordingly, abnormal sound generated when a disengaged state of the engaging portions 129*a*, 129*b* of the tooth row 129 and the engaged portions 21*a*, 21*b* of the rack tooth row 21 is unstable can be avoided. In addition, there is no possibility of friction between the engaging portions 129*a*, 129*b* of the tooth row 129 and the engaged portions 21*a*, 21*b* of the rack tooth row 21.

The protruded portion 32*a* of the sliding portion 32 to be a click portion and the click groove 34 of the slid portion 33 are provided near the operation portion 28. Accordingly, transmission of a tactile sense to the operation portion 28 is facilitated. The tactile sense is generated when the side end regulating member 25*a* is moved to set to the side end position of the standardized size sheet S. Accordingly, operability when the user operates the side end regulating member 25*a* is improved.

Further, if, after the movement of the side end regulating member 25*a* is completed, pressing of the operation portion 28 is released, the operation portion 28 returns to the home position due to restoring forces of the elastic portions 129*c*, 129*d* that are elastically deformed. Because deformation of the elastic portions 129*c*, 129*d* and around the sliding portion 32 to be a click portion is restored to their original states, mold creeping of the elastic portions 129*c*, 129*d* and around the sliding portion 32 to be a click portion can be avoided, stabilizing quality.

Also in the third embodiment, a protruded portion of the sliding portions 12*a*, 12*b* to be a click portion can be provided near the operation member 8 and the click groove 34 can be provided in the slid portions 13*a*, 13*b*. Accordingly, a tactile sense is generated when the side end regulating member 5*a* is set to the side end position of the standardized size sheet S and transmission of the tactile sense to the operation member 8 can be facilitated. The other configuration is the same as in the third embodiment and similar effects can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-196584, filed Sep. 24, 2013, and Japanese Patent Application No. 2013-147390, filed Jul. 16, 2013, which are hereby incorporated by reference herein in its entirety.

What is claimed is:

1. A sheet stacking apparatus comprising:

a stacking unit on which a sheet is stacked; and a regulating unit provided to be moveable in a first direction and a second direction, which is an opposite direction of the first direction, to regulate a position of the sheet by abutting on an end of the sheet stacked on the stacking unit, wherein the stacking unit includes:

a stacking member on which the sheet is stacked; and an engaged portion provided along a direction of movement of the regulating unit and the regulating unit includes:

an abutting portion that abuts on the end of the sheet stacked on the stacking member;

an engaging member including an engaging portion provided to be movable between an engagement position where engaged with the engaged portion and a disengagement position where not engaged with the engaged portion in a direction perpendicular to the direction of movement of the regulating unit and a horizontal direction;

an operation member;

a rotating portion provided in the operation member to rotate around a first rotation fulcrum;

an elastic portion provided in the operation member to be elastically deformed by the rotating portion being rotated; and a disengaging portion provided in the operation member to rotate the engaging portion between the engagement position and the disengagement position by the elastic portion being elastically deformed.

2. The sheet stacking apparatus according to claim 1, wherein the elastic portion is provided between the first rotation fulcrum and the disengaging portion.

3. The sheet stacking apparatus according to claim 1, wherein the elastic portion is thinner than other portions of the operation member.

4. The sheet stacking apparatus according to claim 1, wherein the engaging member is provided rotatably around a second rotating fulcrum.

5. The sheet stacking apparatus according to claim 1, wherein the regulating unit further includes a movement regulating portion that regulates movement of a portion of the operation member in a thickness direction of the sheet stacked on the stacking member.

6. A sheet stacking apparatus comprising:

a stacking unit on which a sheet is stacked; and a regulating unit provided to be movable in a first direction and a second direction, which is an opposite direction of the first direction, to regulate a position of the sheet by abutting on an end of the sheet stacked on the stacking unit, wherein the stacking unit includes:

a stacking member on which the sheet is stacked; and an engaged portion provided along a direction of movement of the regulating unit and the regulating unit includes:

an abutting portion that abuts on the end of the sheet stacked on the stacking member;

an engaging member including an engaging portion provided to be movable between an engagement position where engaged with the engaged portion and a disengagement position where not engaged with the engaged portion in a direction perpendicular to the direction of movement of the regulating unit and a horizontal direction and an elastic deformation portion configured for elastic deformation;

an operation member;

a rotating portion provided in the operation member to rotate around a first rotation fulcrum; and a disengaging portion provided in the operation member to rotate the engaging portion between the engagement position and the disengagement position by the elastic deformation portion being elastically deformed by rotation of the rotating portion.

7. The sheet stacking apparatus according to claim 6, wherein the disengaging portion includes a first disengaging surface and a second disengaging surface, and the engaging portion includes an abutted surface in a circular cross-section shape pressed by the first disengaging surface and the second disengaging surface.

8. The sheet stacking apparatus according to claim 6, further comprising:

a slid portion provided in the stacking unit and arranged along the direction of movement of the regulating unit; and a sliding portion provided in the engaging member and provided on a rear side of the engaging portion to slide along the slid portion accompanying movement of the regulating unit.

9. The sheet stacking apparatus according to claim 6, further comprising:

a groove portion provided in the slid portion to position an end position of a standardized size sheet; and a protruded portion provided in the sliding portion and configured to fit into the groove portion.

10. The sheet stacking apparatus according to claim 6, wherein when the rotating portion rotates, the elastic deformation portion is elastically deformed and the sliding portion abuts on the slid portion and then, the engaging portion is detached from the engaged portion.

11. The sheet stacking apparatus according to claim 1 or 6, wherein the rotating portion is provided to be rotatable in the first direction and the second direction.

12. The sheet stacking apparatus according to claim 1 or 6, wherein with movement of the disengaging portion in the first direction or the second direction, the engaging member moves in the horizontal direction.

13. The sheet stacking apparatus according to claim 1 or 6, wherein the operation member is provided so as to be operable by a user.

14. The sheet stacking apparatus according to claim 1 or 6, wherein the disengaging portion includes a first disengaging surface and a second disengaging surface, and the engaging member moves from the engagement position to the disengagement position by a first disengaged surface of the engaging member being pressed by the first disengaging surface and the engaging member moves from the engagement position to the disengagement position by a second disengaged surface of the engaging member being pressed by the second disengaging surface.

15. The sheet stacking apparatus according to claim 14, wherein an inclination angle of the first disengaging surface and an inclination angle of the first disengaged surface are different and an inclination angle of the second disengaging surface and an inclination angle of the second disengaged surface are different.

16. A sheet feeding apparatus comprising:

the sheet stacking apparatus according to claim 1 or 6; and a feeding portion that feeds a sheet stacked on the stacking member.

17. An image forming apparatus comprising:

the sheet feeding apparatus according to claim 16; and an image forming portion that forms an image on a sheet fed by the sheet feeding apparatus.

* * * * *